US011702905B2

(12) United States Patent
Lisk et al.

(10) Patent No.: US 11,702,905 B2
(45) Date of Patent: Jul. 18, 2023

(54) METHOD FOR FLUID FLOW OPTIMIZATION IN A WELLBORE

(71) Applicant: Oracle Downhole Services Ltd., Nisku (CA)

(72) Inventors: Mahlon Lisk, Nisku (CA); Levi Honeker, Nisku (CA)

(73) Assignee: Oracle Downhole Services Ltd., Nisku (CA)

( * ) Notice: Subject to any disclaimer, the term of this patent is extended or adjusted under 35 U.S.C. 154(b) by 94 days.

(21) Appl. No.: 17/094,586

(22) Filed: Nov. 10, 2020

(65) Prior Publication Data

US 2021/0140288 A1 May 13, 2021

Related U.S. Application Data

(60) Provisional application No. 62/934,949, filed on Nov. 13, 2019.

(51) Int. Cl.
*E21B 34/06* (2006.01)
*E21B 43/12* (2006.01)
(Continued)

(52) U.S. Cl.
CPC ..... *E21B 34/066* (2013.01); *E21B 34/10* (2013.01); *E21B 34/16* (2013.01); *E21B 43/123* (2013.01); *E21B 47/06* (2013.01)

(58) Field of Classification Search
CPC ..... E21B 43/123; E21B 34/066; E21B 34/10; E21B 34/16; E21B 47/06
See application file for complete search history.

(56) References Cited

U.S. PATENT DOCUMENTS 5,273,112 A 12/1993 Schultz
5,937,945 A 8/1999 Bussear et al.
(Continued)

FOREIGN PATENT DOCUMENTS

CA 2856184 A1 1/2015
CA 2873541 A1 6/2015
(Continued)

OTHER PUBLICATIONS

International Search Report and the Written Opinion of the Canadian Intellectual Property Office for PCT Patent Application No. PCT/CA2019/050439 dated Jul. 2, 2019.

*Primary Examiner* — Robert E Fuller
(74) *Attorney, Agent, or Firm* — Park, Vaughan, Fleming & Dowler LLP; Shane Nelson

(57) ABSTRACT

Disclosed is a method and system for fluid flow optimization within a wellbore for gas-lift operations and control of slug flows within the wellbore by utilizing a plurality of electronically controlled valves coupled to a tubing string. Selective actuation of the valves includes incremental opening or closing of an individual valve between a fully open, fully closed, or partial opening of a particular valve. Pressure measurements inside and outside of the tubing string are measured in real-time near the valve to help maintain the desired pressure distribution within the wellbore and to measure and control a pressure differential at a selected valve. Actuation of the valves may be electronically controlled at a remote location by electronic command signals or may be performed automatically by the downhole valves with or without input by a remote system.

55 Claims, 16 Drawing Sheets

(51) Int. Cl.

| | |
|---|---|
| ***E21B 47/06*** | (2012.01) |
| ***E21B 34/16*** | (2006.01) |
| ***E21B 34/10*** | (2006.01) |

(56) References Cited

U.S. PATENT DOCUMENTS

| | | | | |
|---|---|---|---|---|
| 6,070,608 | A | 6/2000 | Pringle | |
| 6,435,282 | B1 | 8/2002 | Robison et al. | |
| 6,715,550 | B2 | 4/2004 | Vinegar et al. | |
| 6,758,277 | B2 | 7/2004 | Vinegar et al. | |
| 6,776,240 | B2 | 8/2004 | Kenison et al. | |
| 6,951,252 | B2 | 10/2005 | Restarick et al. | |
| RE39,583 | E | 4/2007 | Upchurch | |
| 7,387,165 | B2 | 6/2008 | Lopez de Cardenas et al. | |
| 8,186,444 | B2 | 5/2012 | Patel | |
| 8,752,629 | B2 | 6/2014 | Moen | |
| 8,905,128 | B2 | 12/2014 | Arizmendi, Jr. et al. | |
| 9,228,402 | B2 | 1/2016 | Strilchuk | |
| 9,228,423 | B2 | 1/2016 | Powell et al. | |
| 9,291,033 | B2 | 3/2016 | Scott et al. | |
| 9,316,076 | B2 | 4/2016 | Longfield et al. | |
| 9,453,389 | B2 | 9/2016 | Anderson et al. | |
| 9,896,906 | B2 | 2/2018 | Tunkiel et al. | |
| 9,903,182 | B2 | 2/2018 | Getzlaf et al. | |
| 9,970,262 | B2 | 5/2018 | Werriers et al. | |
| 10,066,467 | B2 | 9/2018 | Getzlaf et al. | |
| 10,280,708 | B2 | 5/2019 | Lamb | |
| 10,323,481 | B2 | 6/2019 | Pratt et al. | |
| 10,370,945 | B2 * | 8/2019 | Boiko | G05B 13/041 |
| 10,443,344 | B2 | 10/2019 | Vasques et al. | |
| 10,480,284 | B2 | 11/2019 | Watson | |
| 2002/0029883 | A1 * | 3/2002 | Vinegar | E21B 43/123 166/250.03 |
| 2004/0055752 | A1 | 3/2004 | Restarick | |
| 2006/0124310 | A1 | 6/2006 | Lopez de Cardenas | |
| 2008/0041586 | A1 * | 2/2008 | Eken | E21B 43/121 166/54.1 |
| 2012/0043092 | A1 | 2/2012 | Arizmendi | |
| 2013/0087343 | A1 * | 4/2013 | Juenke | E21B 43/123 166/321 |
| 2015/0060084 | A1 | 3/2015 | Moen et al. | |
| 2016/0061004 | A1 | 3/2016 | Funkiel et al. | |
| 2017/0292351 | A1 * | 10/2017 | Boiko | E21B 43/122 |
| 2017/0336811 | A1 | 11/2017 | Stone et al. | |
| 2018/0020229 | A1 | 1/2018 | Chen et al. | |
| 2018/0202269 | A1 | 7/2018 | Wensrich | |
| 2018/0274331 | A1 * | 9/2018 | Richards | E21B 34/14 |
| 2019/0085658 | A1 | 3/2019 | Reid | |
| 2019/0235007 | A1 | 8/2019 | Williamson et al. | |
| 2019/0316440 | A1 * | 10/2019 | Honeker | E21B 47/07 |
| 2020/0063525 | A1 | 2/2020 | Frazier et al. | |
| 2021/0062614 | A1 | 3/2021 | Hopmann et al. | |
| 2021/0172300 | A1 * | 6/2021 | Rodger | E21B 43/123 |

FOREIGN PATENT DOCUMENTS

| | | | |
|---|---|---|---|
| CA | 2906464 | A1 | 3/2016 |
| CA | 2916168 | A1 | 6/2016 |
| CA | 3017294 | A1 | 9/2016 |
| CA | 2927973 | A1 | 10/2016 |
| CA | 2948249 | A1 | 5/2017 |
| CA | 2991729 | A1 | 1/2018 |
| CA | 2996116 | A1 | 8/2018 |
| CA | 2923662 | C | 10/2018 |
| EP | 1234100 | B1 | 2/2005 |
| WO | 2017204654 | A1 | 11/2017 |
| WO | 2019148279 | A1 | 8/2019 |

* cited by examiner

METHOD FOR FLUID FLOW OPTIMIZATION IN A WELLBORE

This application claims priority to U.S. provisional patent application no. 62/934,949, filed on Nov. 13, 2019, the entire content of which is incorporated herein by reference.

BACKGROUND OF THE INVENTION

Field of the Invention

The present invention relates to a system and method for the production or injection of fluids from a wellbore, and particular for gas-lift operations and carbon dioxide ($CO_2$) sequestration.

Description of the Related Art

In the oil and gas industry, downhole valves are used as part of a tubing string to permit fluid communication between the formation or reservoir through which a wellbore intersects. Such valves may be used to produce fluids into the tubing string, which may be lifted to the surface using natural reservoir pressure or artificial lift solutions. Downhole valves may also be used to inject fluids into the wellbore or the annulus between the well casing and production tubing. Injected fluids can include chemicals to enhance oil recovery or stimulation fluids such as demulsifiers, corrosion inhibitors, scale inhibitors, or paraffin inhibitors. The various chemicals and their intended effects are well known in the industry.

Mechanically actuating downhole valves and controlling them to control their opening and closing are non-trivial issues, and many different solutions have been proposed and implemented in the art. Potential solutions must accommodate harsh downhole conditions, dimensional limitations imposed by tubing size, and other known difficulties. In general, conventional downhole valves are based on hydraulics and do not use control sensors to drive the position of the valve inlet/outlet; conventional valves are partially (or fully) opened or closed by hydraulic control lines from the downhole valve and the surface. Conventional valves present numerous problems. For example, a conventional hydraulic valve requires a separate control line from the wellhead to each downhole valve, which practically limits the number of downhole valves possible. Another problem includes complicated wellhead exits due to the number of control lines used in a well. Further, deep wells require increased surface pressure to actuate downhole valves, which becomes a safety hazard. Still further, if one return line is used for all downhole valves, if it fails, all the lines fail and/or all downhole valves are rendered inoperable.

There are existing technologies that relate to a downhole valve. See, e.g., U.S. Pat. Nos. 8,555,956; 8,776,896; 9,903,182; 9,970,262; 10,066,467; 10,280,708; and U.S. Patent Publication No. 2018/0171751, incorporated herein by reference. As another example, Schlumberger offers a production system named Manara. The Manara system utilizes a single control line that connects multiple downhole valves. However, the Manara product uses wellbore pressure to actuate the control valve, which is large and expensive.

There are existing technologies that relate to fluid flow optimization for wellbores. See, e.g., U.S. Pat. Nos. 6,758,277, 6,070,608, and 5,937,945, incorporated herein by reference. For example, it is generally known that gas can be injected into a well and used to increase oil production where the reservoir natural lift is insufficient. As described in U.S. Pat. No. 6,758,277, in a gas-lift oil well, natural gas produced in the oil field is compressed and injected in an annular space between the casing and tubing and is directed from the casing into the tubing to provide a "lift" to the tubing fluid column for production of oil out of the tubing. The typical gas-lift method injects fluid into the annular space to produce fluids from inside the tubing. For injection into the tubing and production from the annular casing, a separate method is typically employed, and generally requires a workover of the drill string and the installation of new tubing and downhole equipment. Further, typical gas-lift wells use mechanical valves attached to the tubing to regulate the flow of gas from the annular space into the tubing string. These prior art valves are typically bellows-type valves that open or close based on a predetermined pressure point. The pressure setting for each valve is typically selected based on a number of factors, such as position of the valve in the well, the pressure head, and the physical condition of the well downhole. Such a system and operation thereof is problematic for a variety of reasons. First, many of these conditions or factors are assumed or unknown, making the pre-set pressure condition of each valve guesswork. Second, many of these downhole conditions change over the production life of the well. Third, these valves and related operating methods result in an unequal pressure distribution through the wellbore, which is not desired and detrimental to the efficiency and effectiveness of oil-lift operations. Fourth, typical valves and gas-lift operations do not provide selective and individual control over each valve, do not allow for incremental changes for a valve, and do not provide optimized control over all of the valves to produce desired pressure differentials.

A need exists for an improved method and system for remotely actuating, controlling, and/or monitoring of a downhole valve and the associated fluid flows through the valve. A need exists for an improved method and system for the actuation, control, and/or monitoring of a plurality of downhole valves. A need exists for an improved method and system for artificial lift applications. A need exists for better and/or more uniform pressure control within a downhole system for artificial lift. A need exists to better control and prevent slug flows in an artificial lift application. A need exists to better control fluid flows in a downhole tubular setting during oil and gas injection and production operations.

SUMMARY OF THE INVENTION

The present disclosure provides a method and system for fluid flow optimization within a wellbore by utilizing a plurality of electronically controlled valves placed along a tubing string within the wellbore, such as gas-lift operations and control of slug flows within the wellbore. Selective actuation of the valves may include incremental opening or closing of an individual valve as needed or desired, and may include partial or full opening or closing of a particular valve. Pressure measurements inside and outside of the tubing string may be measured in real-time near the valve to help maintain the desired pressure distribution within the wellbore and to measure and control a pressure differential at a selected valve. Actuation of the valves may be electronically controlled at a remote location by electronic command signals or may be performed automatically by the downhole valves with or without input by a remote system. The disclosed valve allows for injection into or production from the tubing string, and thus reverse fluid flow operations may be performed without a workover.

Disclosed is a method of operating a plurality of downhole valves in a wellbore, comprising measuring a pressure differential at each of a plurality of downhole valves coupled to a tubing string in a wellbore and selectively actuating each of the plurality of downhole valves based on the measured pressure differential. The method may comprise injecting fluid into the tubing string, whether into the tubing string and out of the annulus, or into the annulus and out of the tubing string. The measured pressure differential is calculated as the difference between a first pressure at an inside portion of the tubing string and a second pressure at an outside portion of the tubing string. The method may comprise maintaining a desired pressure differential at each of the plurality of downhole valves based on the actuating step. The method may comprise maintaining a substantially equal pressure distribution within the wellbore based on the actuating step.

The actuating step may comprise selectively actuating each of the plurality of downhole valves between a closed position and an open position. The actuating step may comprise performing incremental changes to a valve opening on each of the plurality of downhole valves. The actuating step may comprise partially opening and partially closing each of the plurality of downhole valves. The actuating step may comprise partially opening each of the plurality of downhole valves to a desired opening percentage. The actuating step may comprise opening a lower valve of the plurality of downhole valves while closing the immediately preceding valve. The actuating step may comprise opening each of the plurality of downhole valves to a partial opening prior to fully opening the valve, such as less than a 25% opening or a 50% opening. The actuating step may be performed automatically or manually. The actuating step may be performed with a control signal provided to each of the plurality of downhole valves from a remote location, or without such a remote control signal. The actuating step may comprise electronically actuating the plurality of downhole valves into an open position or closed position based on the measured pressure differentials. The actuating step may comprise selectively actuating each of the plurality of downhole valves to meet a desired pressure differential at each of the plurality of downhole valves. The actuating step may comprise actuating at least some of the plurality of downhole valves based on time delay. The actuating step may comprise opening at least some of the plurality of downhole valves a predetermined amount based on a predetermined period of time. The actuating step may comprise opening at least some of the plurality of downhole valves a predetermined amount based on a predetermined pressure differential change.

The method may comprise identifying and/or controlling a slug flow or other intermittent fluid flow issue. The method may comprise selectively opening a portion of the plurality of downhole valves to control a slug flow within the wellbore. The method may comprise determining the presence of intermittent fluid flow within the wellbore based on an increased pressure differential of the measured pressure differentials. The method may comprise controlling a slug flow within the wellbore based on the selective actuation step. The method may comprise identifying a group of the plurality of downhole valves near a slug flow and selectively opening the group of the plurality of downhole valves. The method may comprise closing all but one of the plurality of downhole valves to control the slug flow.

Also disclosed is a method of operating a gas-lift oil well that comprises injecting gas into a tubing string within a wellbore, wherein the tubing string comprises a plurality of downhole valves, measuring a pressure differential at each of the plurality of downhole valves, and selectively actuating each of the plurality downhole valves based on the measured pressure differential. The method may comprise adjusting a valve opening of each of the plurality of downhole valves to maintain a desired pressure differential at each of the plurality of valves. The method may comprise measuring a pressure differential at each of the plurality of downhole valves. The method may comprise maintaining only one of the plurality of downhole valves in a substantially open position. The method may comprise maintaining only two of the plurality of downhole valves in a substantially open position. The method may comprise adjusting an opening of at least two of the plurality of downhole valves at the same time. The method may comprise maintaining a bottom valve of the plurality of downhole valves in a substantially open position while injecting gas into the tubing string.

The plurality of downhole valves may be located at different vertical positions within the wellbore, such that a first valve is located at a first vertical position and a second valve is located at a second vertical position vertically lower than the first valve within the wellbore. In such a configuration the first and second valves may be adjusted between an open and closed position by a wide variety of sequences. The method may comprise partially opening the first valve and fully opening the first valve after partially opening the first valve. The method may comprise opening the first valve at a first pressure differential at the first valve and opening the second valve at a second pressure differential at the second valve. The method may comprise partially opening the second valve after the first valve has been fully opened. The method may comprise at least partially closing the first valve after the second valve has been fully opened. The method may comprise opening the second valve while closing the first valve. The method may comprise closing the first valve after partially opening the second valve. The method may comprise substantially opening the second valve after substantially closing the first valve.

Also disclosed is a method of operating a gas-lift oil well that comprises injecting gas into a tubing string within a wellbore, wherein the tubing string comprises a plurality of downhole valves coupled to the tubing string, measuring a fluid parameter at each of the plurality of downhole valves, and selectively actuating each of the plurality of downhole valves based on the measured fluid parameter. The fluid parameter may be a wide number of measurable fluid parameters (whether temperature, pressure, or fluid flow rate), including a pressure differential, a pressure inside of the tubing string, a pressure outside of the tubing string, and/or a fluid flow rate through the valve.

Also disclosed is a downhole valve system that comprises a plurality of downhole valves coupled to a downhole tubular within a wellbore, wherein each of the plurality of downhole valves is configured to be selectively actuated at least between a fully open position and a fully closed position based on an electronic signal. Each of the plurality of downhole valves may be configured to be selectively actuated between a plurality of partially opened positions. Each of the plurality of downhole valves may be configured to measure a pressure differential based on a first pressure sensor coupled to an inside portion of the tubular and a second pressure sensor coupled to an outside portion of the tubular. Each of the plurality of downhole valves may be configured to move between an open position and a closed position based on a measured pressure differential at the valve. The selective actuation may be based on a measured pressure differential at each of the plurality of downhole valves or may be based on a measured fluid parameter at each of the plurality of downhole valves. The system may comprise any number of downhole valves. The downhole valves may comprise at least two or three valves located within the wellbore and a bottom most valve. The plurality of downhole valves comprises a first valve located at a first vertical position in the wellbore, a second valve located at a second vertical position in the wellbore lower than the first valve, a third valve located at a third vertical position in the wellbore lower than the second valve, and a bottom valve.

The system may comprise a control system coupled to each of the plurality of downhole valves. The control system may be located at a remote location from the plurality of downhole valves and may be coupled to the plurality of downhole valves by an electrical cable. Each of the plurality of downhole valves may have its own control system, such as a processor coupled to a motor that is configured to actuate the valve from a closed position to an open position. The control system may be configured to selectively actuate each of the plurality of downhole valves to move between an open position and a closed position.

BRIEF DESCRIPTION OF THE DRAWINGS

The following drawings form part of the present specification and are included to further demonstrate certain aspects of the present invention. The invention may be better understood by reference to one or more of these drawings in combination with the detailed description of specific embodiments presented herein.

DETAILED DESCRIPTION

Figure 1A:
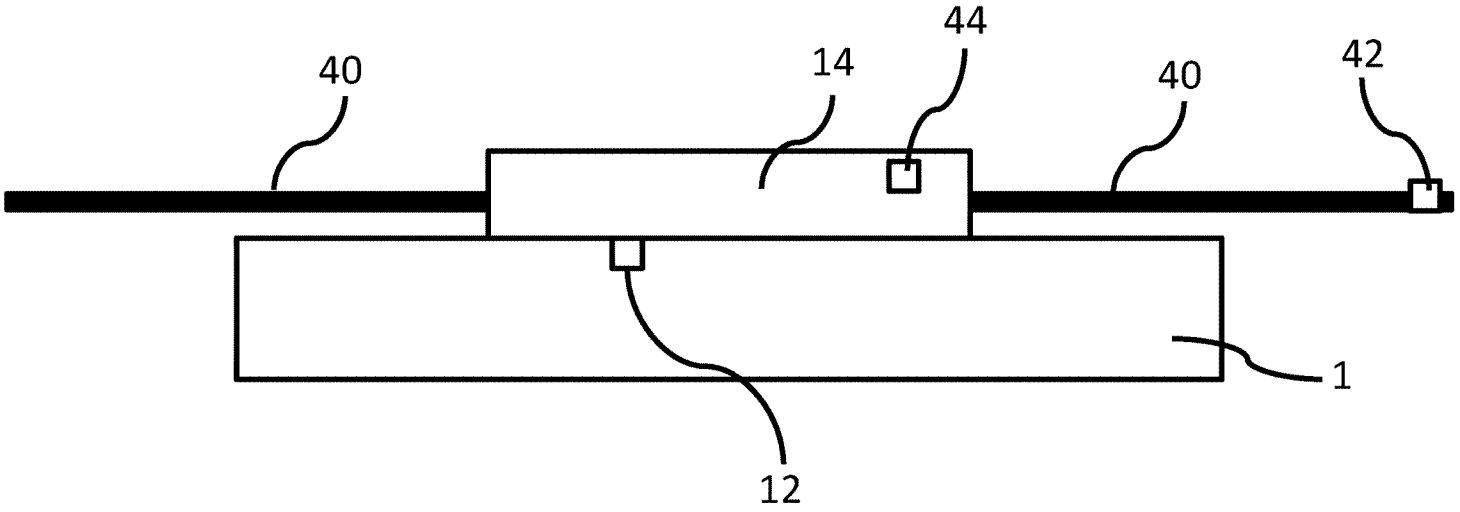
FIG. 1A illustrates a schematic view of a downhole valve assembly coupled to a tubing string according to one embodiment of the present disclosure.

Various features and advantageous details are explained more fully with reference to the nonlimiting embodiments that are illustrated in the accompanying drawings and detailed in the following description. Descriptions of well-known starting materials, processing techniques, components, and equipment are omitted so as not to unnecessarily obscure the invention in detail. It should be understood, however, that the detailed description and the specific examples, while indicating embodiments of the invention, are given by way of illustration only, and not by way of limitation. Various substitutions, modifications, additions, and/or rearrangements within the spirit and/or scope of the underlying inventive concept will become apparent to those skilled in the art from this disclosure. The following detailed description does not limit the invention.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures, or characteristics may be combined in any suitable manner in one or more embodiments.

As used herein, longitudinal or "axial" means aligned with the long axis of tubular elements associated with the disclosure, and transverse means a direction that is substantially perpendicular to the longitudinal direction. As used herein, uphole and downhole are used to describe relative longitudinal positions of parts in the well bore. One of skill in the art will recognize that wellbores may not be strictly vertical or horizontal, and may be slanted or curved in various configurations. Therefore, the longitudinal direction may or may not be vertical (i.e., perpendicular to the plane of the horizon), and the transverse direction may or may not be horizontal (i.e., parallel to the plane of the horizon). Further, an uphole part may or may not be disposed above a downhole part. As used herein, tubing string may refer to any tubular structure in a wellbore that may be used to convey fluid in a wellbore. Non-limiting examples of tubing string include rigid pipe segments, and coiled tubing.

Overview

The content of U.S. Patent Publication No. 2019/0316440 ("the '440 Patent Publication"), entitled Downhole Valve for Production or Injection, is incorporated herein by reference.

Disclosed is a method and system for fluid flow optimization in a wellbore. In particular, disclosed is a method and system for gas-lift operations and other improved fluid flow operations. In one embodiment, the utilized downhole valve assembly may be the same or similar to the valve described in the '440 Patent Publication, which is incorporated herein by reference. However, one of skill in the art will recognize that this invention is not necessarily limited to such a valve, and other valves may similarly be used with the disclosed processes and methods described herein.

In operation, the disclosed valve assembly may be used to monitor and/or control any injection and/or production operation of a downhole operation. In one embodiment, multiple valve assemblies may be remotely controlled downhole via a single control line connecting each of the valve assemblies. Injection or stimulation operations may include, but are not limited to, enhanced oil recovery (EOR), carbon dioxide ($CO_2$) injection, artificial gas lift, and automated oil and gas production. Production operations may include optimizing the flow of oil and/or gas through various downhole valves placed between stimulated intervals in zones or compartments (such as those separated by packers). In one embodiment, the actuation of a particular valve assembly is based on logic within the valve assembly and sensor measurements from the downhole valve assembly. In other embodiments, automatic processing steps or other logic operations may be performed at a remote location (such as by a computer near the wellbore surface or any computer system wirelessly connected to the downhole valves).

In one embodiment, disclosed is an artificial lift system and method that utilizes a plurality of valves positioned along the tubing string within the production casing. The plurality of valves may be used for a gas-lift operation to inject gas into the tubing to produce fluid from the annulus, or to inject gas into the annulus to produce fluid from the tubing. In one embodiment, more than 30 valve assemblies may be electrically connected to a surface location via a single electronic control line. Each valve may be open and/or closed based on pressure measurements by sensors within the valve assembly. In one embodiment, the artificial lift operations may include initiation of a well for gas injection, monitoring pressure fluctuations to create a substantially balanced pressure distribution within the well, slug flow control, and/or well depletion operations. In one embodiment, the gas-lift method may include opening the plurality of valves, one at a time, to create a balanced pressure distribution within the tubing string to initiate gas-lift operations. In one embodiment, the gas-lift method may include opening a single downhole valve until a pressure setpoint is achieved at that valve and then opening a lower downhole valve while closing the prior valve. In one embodiment, the gas-lift method may include maintaining a desired pressure at the lowest downhole valve with the valve open while keeping the rest of the downhole valves substantially closed.

As can be appreciated, the disclosed valve assembly and operation thereof provides numerous benefits. It allows for bi-directional flow through the valve assembly; in other words, the operator may control inflow and outflow through the valve assembly. The disclosed valve assembly allows for full and infinite control over the valve assembly and fluid flow through the tubing string. The disclosed valve assembly provides an adjustable, quick-response, and electric flow control valve that is fully controllable from a remote location. The disclosed valve and system allows for optimal production and recovery of downhole operations by the real-time, continuous, individual, and simultaneous management and control of multiple valve assemblies. Thus, multiple zones (including additional lateral or horizontal wells) may be continuously measured in real time. A single electrical control line may be coupled to each downhole valve assembly, which allows bi-directional telemetry data for diagnostics, control, and measurements for all of the downhole valves without requiring a hydraulic control line or separate lines for each valve. As can be appreciated, such control reduces overall operating costs for the well, including time, cost, and risk reduction by minimizing well interventions, and enhances oil recovery and reduces the decline in oil or gas production for a well.

The present disclosure provides a method and system for fluid flow optimization within a wellbore, such as gas-lift operations and control of slug flows within the wellbore, by utilizing a plurality of electronically controlled valves coupled to a tubing string. Selective actuation of the valves may include incremental opening or closing of an individual valve as desired between a fully open, fully closed, or partial opening of a particular valve. Pressure measurements inside and outside of the tubing string may be measured in real-time near the valve to help maintain the desired pressure distribution within the wellbore and to measure and control a pressure differential at a selected valve. Actuation of the valves may be electronically controlled at a remote location by electronic command signals or may be performed automatically by the downhole valves with or without input by a remote system.

In general, the present disclosure provides a method and system that allows for individual and selective control over each valve along the tubing string. Based on logic within the valve itself and/or or based on control signals from a remote location, each of the valves may be moved between a fully closed position and a fully open position, as well as any number of intermediate partially opened/closed positions. In one embodiment, each valve is configured to measure a parameter of the fluid adjacent to the valve and control the fluid through the valve based on the measured parameter. For example, each valve may be configured to measure a pressure differential at the valve (e.g., the difference in pressure between the inside of the tubing string and the outside of the tubing string near the valve) and incrementally move an opening of the valve based on the measured differential. Such steps may be performed sequentially along the length of the tubing string to selectively control with great precision fluid flow along the wellbore and the tubing string. Such control can greatly increase the production of a well, increase the effectiveness of artificial gas lift operations, increase the speed of artificial gas lift operations, increase the pressure uniformity within a wellbore, and decrease and/or prevent slug flows within a wellbore.

Valve

In one embodiment, the utilized downhole valve assembly may be the same or similar to the valve described in U.S. Patent Publication No. 2019/0316440 ("the '440 Patent Publication"), which is incorporated herein by reference. However, one of skill in the art will recognize that this invention is not necessarily limited to such a valve, and other valves may similarly be used with the disclosed processes and methods described herein. In one embodiment, any downhole valve that allows for selective partial opening and partial closing of an individual valve along a tubing string may be used. While one embodiment of the valve uses remote electronic signals over a control wire, wireless control signals may be utilized, such as wireless electronic or hydraulic communications.

In one embodiment, a valve assembly of the present disclosure is configured to attach to or be part of a tubing string used to convey fluids in a wellbore. In one embodiment, the tubing string comprises conventional jointed tubing. In one embodiment, the tubing string may be located in a horizontal well, a vertical well, and/or one or more lateral wells, and may even be used in open hole (e.g., sea) applications. In one embodiment, the disclosed valve assembly may be for water and/or polymer applications, and allows for increased production, water, and/or gas injection flow, control, and/or monitoring in downhole conditions. As may be appreciated, the downhole valve can be used in a wide variety of downhole operations and conditions. The disclosed system provides accurate, real-time data of downhole conditions on the inside and outside of the tubing string and allows for the monitoring and changing of valve positions for a plurality of downhole valves via electronic signals.

In one embodiment, the disclosed valve assembly is not mechanically actuated and is rather electronically controlled from a remote location (such as on the surface) by one or more electronic signals. Electronic control provides full control of the valve orifice from fully open to fully closed, and allows positive feedback and known orientation of the valve assembly. Any percentage (from 0 to 100 percent, such as 26 percent open) can be set and feedback provided on the valve position. In other words, the present disclosure provides continuous measurements and infinite individual control via real-time data for a plurality of downhole valves. Control may be performed remotely at the surface without entering the well with any additional tools; in other words, the disclosed valves are configured to be electronically activated, monitored, and controlled from the surface.

In one embodiment, a plurality of valves as disclosed herein may be positioned along the tubular string and be coupled by a single cable for electronic control. The plurality of valves may be positioned at regular or variable intervals along the tubular string. In one embodiment, a cable may be coupled to the valve assembly and may travel outside or inside of the tubing string between the valve assembly and a surface location. In some embodiments, the disclosed valves and/or the cable between the valve(s) may include sensors for additional control and/or feedback related to the valves. The cable may be traditional tubing encapsulated cable (TEC) and/or other downhole instrumentation cable. The cable and coupled valves allows control of the plurality of valves from a remote location.

FIG. 1A illustrates a schematic of one embodiment of the present disclosure. Valve assembly 14 may be coupled to an exterior portion of tubing string 1. In one embodiment, the tubing string comprises conventional jointed tubing and is used to convey fluids in a wellbore. As is known in the art, tubing string 1 may have a plurality of tubing subs 310 (see FIG. 3A) that are positioned in line with the tubing string. The sub may have threaded ends which match the threaded ends of the jointed tubing. In one embodiment, the tubing sub may be in effect a downhole mandrel on which other components are arranged or assembled (such as the disclosed valve). As is known in the art, a mandrel is a specialized tubular component such as a bar, tube, shaft, or spindle around which other components are arranged or assembled. A tubing sub, as disclosed herein, may be used interchangeably with a mandrel. In one embodiment, a portion of the tubing string, such as the tubing sub, may have valve opening/orifice 12 through a wall of the pipe, which allows fluids to enter or exit the tubing string. Valve opening 12 is a controlled inlet and outlet orifice to the tubing string. In one embodiment, valve assembly 14 may be positioned adjacent to valve opening 12 such that a portion of the valve assembly with a lateral opening is in fluid connection with valve opening 12. As shown in detail in subsequent figures, valve assembly 14 comprises an additional passage that allows fluids to enter or exit the valve assembly as desired from an exterior portion of the tubing string (such as an annulus of a well), and consequently, allows fluid to enter or exit the tubing string through the fluid connection between valve 14 and valve opening 12.

In one embodiment, valve assembly 14 may be electronically coupled to other downhole equipment and the surface via electric cable 40. Electric cable 40 may be any downhole instrumentation cable, such as tubing encapsulated cable (TEC), and may transmit data and/or power between various downhole devices, such as a plurality of downhole valve assemblies and/or sensors. In one embodiment, cable 40 is a 4 conductor, ¼ TE cable that allows data communication between downhole equipment (tools, sensors, etc.) and the surface. Cable 40 may be directly or indirectly coupled to valve assembly 14, such as by induction means or wet or dry electrical connectors. In one embodiment, valve assembly may also comprise one or more sensors 44 to monitor various conditions downhole. Sensor 44 may be located within or adjacent to the valve assembly. In one embodiment, electrical cable 40 is directly coupled to a control circuit within the valve assembly, which is then directly coupled to one or more sensors 44. In one embodiment, sensor 44 may comprise a wide variety of sensors as is known in the art, such as temperature, pressure, acoustic, and flow rate. In another embodiment, cable 40 may also comprise sensors 42 (exterior to the valve assembly) to monitor various conditions downhole. Valuable data may be collected and read from the surface, in real-time or near real-time, by the telemetry sensors and/or cable 40.

As described herein, one embodiment of the disclosed valve assembly is coupled to a tubing sub (or mandrel) that is substantially in-line with a tubing string. The tubing string may be located in a horizontal, vertical, or lateral well. Further, the disclosed valve assembly can be attached to a tubing string, production liner, slotted liner, coiled tubing, and even surface lines. In other words, the disclosed valve assembly may be coupled to a wide variety of tubulars, fluid passageways, or fluid containing devices to control fluid flow in and out of the relevant device. Still further, while one embodiment of the disclosed valve assembly is located downhole, the valve assembly disclosed herein is not limited to downhole applications and in some embodiments may be used in surface applications.

Figure 1B:
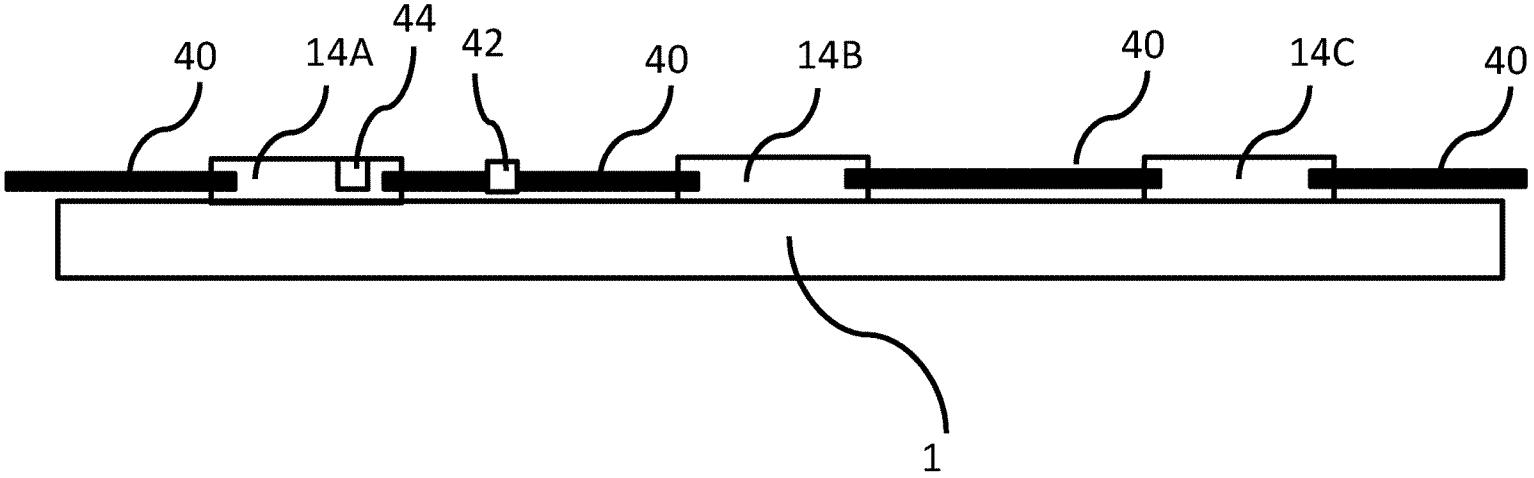
FIG. 1B illustrates a schematic view of a plurality of downhole valve assemblies coupled to a tubing string according to one embodiment of the present disclosure.

FIG. 1B illustrates a schematic of another embodiment of the present disclosure. In one embodiment, a plurality of downhole valves 14 (such as 14A, 14B, and 14C) may be coupled to tubing string 1. A single electrical cable 40 may be coupled to each valve and allow for remote electronic control of each of the plurality of valves at a remote location, such as the well surface. In one embodiment, the tubing string may be located in a horizontal well, a vertical well, and/or one or more lateral wells, and the plurality of valves (and sensors) allows for better monitoring and control of each section of the well. Depending on the connection to each of the valve assemblies, cable 40 may have a plurality of separate cable sections, but still may be considered as a single electrical cable. As in FIG. 1A, cable 40 may be coupled to a plurality of sensors 42, 44 positioned at different points along the cable to monitor downhole conditions along an exterior portion of the tubing string, such as within (see, e.g., sensor 44) and/or adjacent (see, e.g., sensor 42) to each of the valve assemblies. The use of downhole sensors connected to the cable allows for more accurate monitoring of downhole conditions, and in one embodiment, control of a particular valve assembly (and the results thereof) is monitored by the adjacent sensors. For example, valve assembly 14A may be directed to open to a certain "open" position, and the sensor(s) within valve 14A may be monitored to determine the effect of opening valve 14A on one or more fluid parameters, such as flow rate. Depending on the desired downhole parameter, valve 14A may be adjusted based on the results from sensors 44. Similarly, each valve may be separately controlled and monitored. In one embodiment, at least thirty (30) valves may be linked together to a single electrical cable for distances up to 5000 meters. Of course, one of skill in the art will realize that additional valve and additional distances may be achieved based on the design of the well, cable, and downhole assemblies. The valves may be separated by fixed, regular, or variable intervals.

Figure 1C:
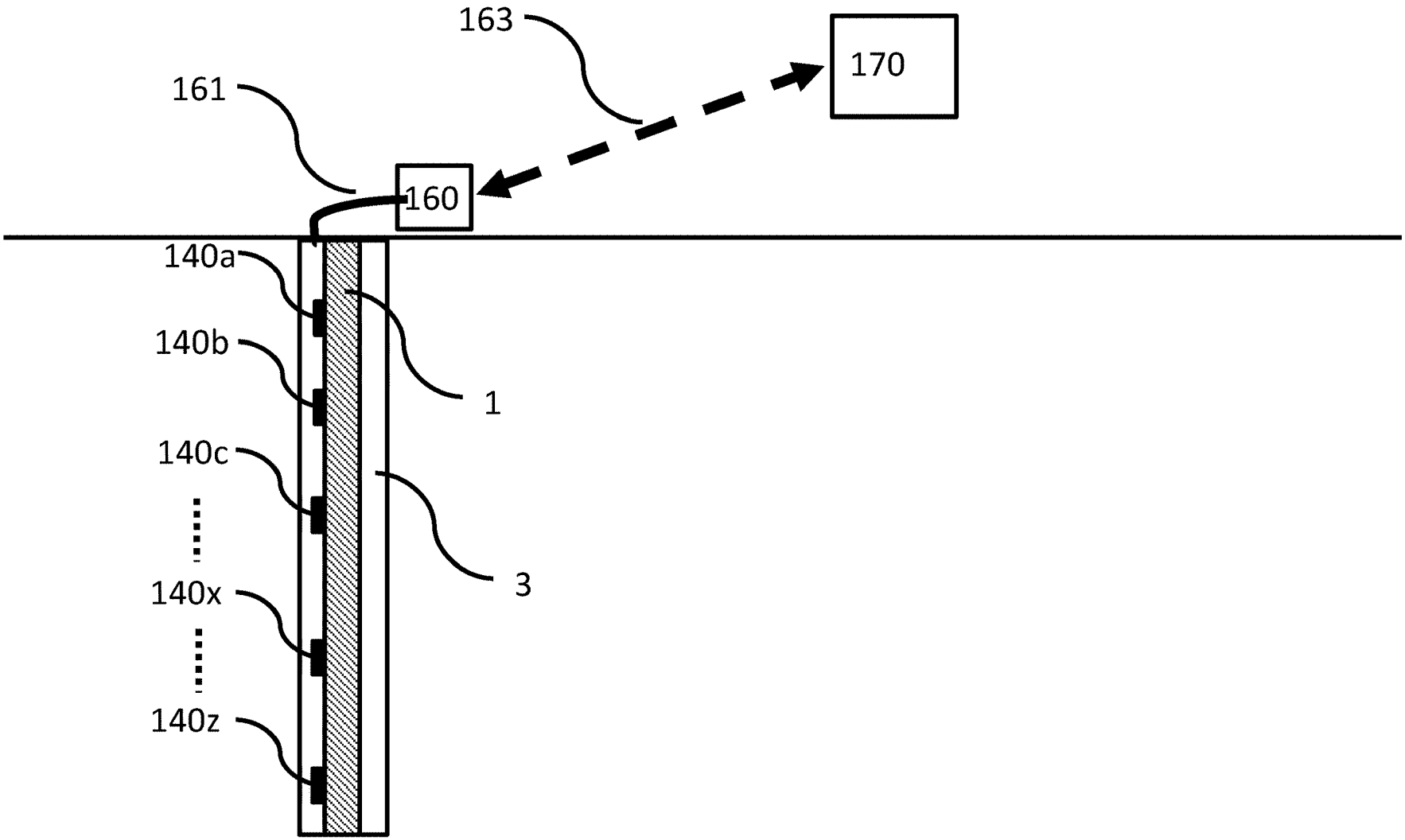
FIG. 1C illustrates a schematic view of a plurality of downhole valve assemblies coupled to a tubing string according to one embodiment of the present disclosure.

FIG. 1C illustrates a schematic of another embodiment of the present disclosure. In one embodiment, a plurality of downhole valves 140 (such as 140*a*, 140*b*, 140*c*, . . . , 140*x*, . . . , and 140*z*) may be coupled to tubing string 1 which is located within a cased wellbore thereby forming annulus 3 outside of tubing 1. In one embodiment, each of the plurality of downhole valve has one or more pressure sensors coupled to the valve that measures an inside pressure of the tubing string and a pressure outside of the tubing string in annulus 3, such as described in relation to FIG. 1B or FIG. 2C. In one embodiment, a control system 160 may be located at or near the wellbore surface, and is thus a remote control system relative to each of the downhole valves. Control system 160 is electrically coupled to each of the plurality of downhole valves 140. In one embodiment, control system is coupled to the downhole valves by a single control wire 161, such as described in relation to FIGS. 1A and 1B. In other embodiments, the control system may communicate with and/or control each of the downhole valves by a wireless electronical signal as is known in the art. In one embodiment, control system 160 may be in communication with one or more additional control systems remote from the first control system and the downhole valves, such as second remote control system 170. Second remote control system 170 may be any number of computing devices, such as a computer, smartphone, or other simple electronic handheld device. In one embodiment, first control system 160 and second control system 170 are coupled together by the Internet or similar data transfer medium. Such a second remote control system may simply be a platform in which data from the downhole valves may be monitored, and in some embodiments the second remote control system allows for manual input and other automatic control system operations to be computed and then transmitted to the first control system and subsequently to the plurality of downhole valves. In one embodiment, the operating conditions of the downhole valve and other operating parameters or measurements (such as the pressure measurements inside and outside of the tubing) may be communicated in real-time or near real-time to remote control system 160. Remote control system 160 may be configured with the necessary logic and process control instructions to automatically determine which valve shall be opened at what time and to what extent. In some embodiments, each downhole valve has such software and hardware to perform such automatic control operations without assistance from a remote control system. In some embodiments, each downhole valve may communicate with each of the other downhole valves to assist in the automatic control of the downhole valves without requiring remote control, instructions, or assistance by remote control system 160. Again, such communications are preferably done via wired communications on a physical wire connecting each of the valves together, but may also be done via wireless techniques.

Figure 2A:
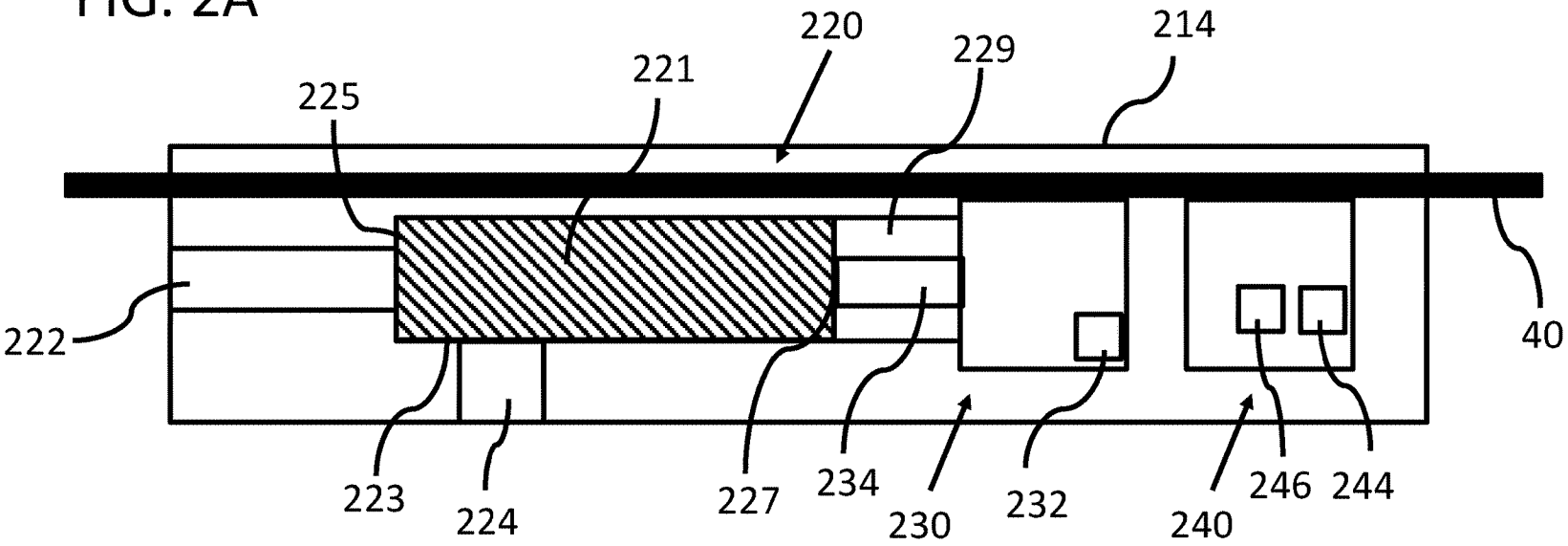
FIG. 2A illustrates a schematic view of a downhole valve assembly in a substantially closed position according to one embodiment of the present disclosure.
Figure 2B:
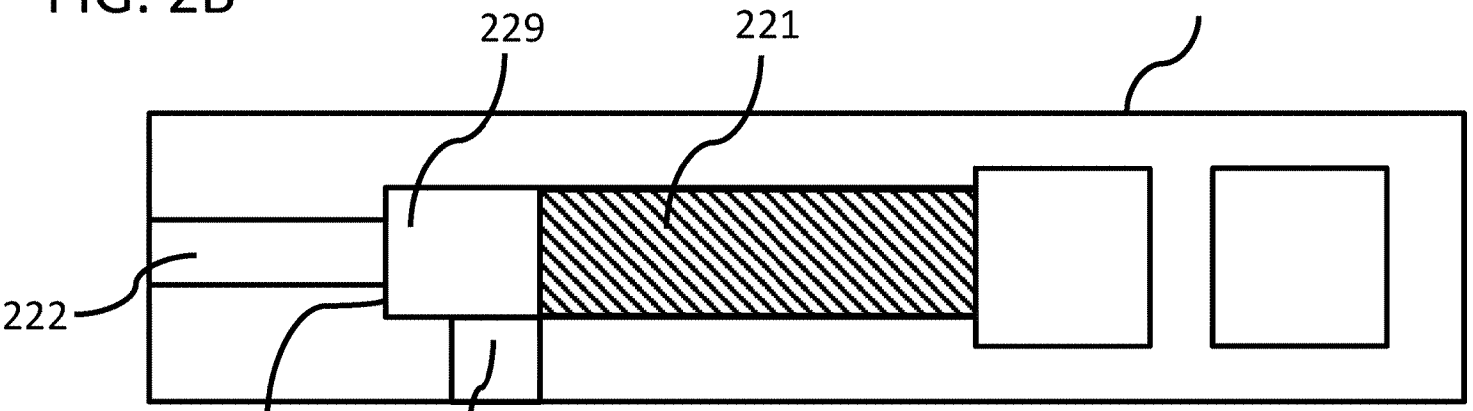
FIG. 2B illustrates a schematic view of the downhole valve assembly in a substantially open position according to one embodiment of the present disclosure.

FIGS. 2A and 2B illustrate a schematic view of one embodiment of a valve assembly of the present disclosure, in a substantially closed and open position, respectively. The valve assembly and components in FIGS. 2A and 2B are the same, but for simplicity many of the elements in FIG. 2B are not numbered. For the purposes of this disclosure, an open position may be considered as the position of the valve plug within the valve assembly when the plug (or dart) is retracted beyond orifice 224 to allow fluid flow between a first port and a second port of the valve assembly, while a closed position within the valve assembly may be considered as the position when the valve plug (or dart) contacts a sealing face or valve seat within the valve assembly to prevent fluid flow between the first and second ports of the valve assembly. Of course, the valve assembly may be actuated to any number of incremental positions between the substantially open and substantially closed position as desired and as described herein.

As illustrated in FIGS. 1A and 1B, the valve assembly may be coupled to a tubing sub and/or tubing string and be used to control fluid flow into or out of the tubing string at isolated locations along the tubing string. Valve assembly may be coupled to electrical cable 40, and as shown in FIG. 1B, a plurality of valves may be located on the tubing string and be electrically coupled together and/or with a remote location (e.g., the surface) via TEC cable 40.

As illustrated in FIG. 2A, in one embodiment, valve 214 comprises valve section 220, power section 230, and electronics section 240. In one embodiment, electronics section 240 is coupled to power section 230 which is coupled to valve section 220. In one embodiment, the various sections or systems may each comprise a number of elements. In one embodiment, each section and/or element of the valve assembly may be threaded and/or coupled together to form an inner cavity in which some of the valve assembly components fit within.

In one embodiment, valve section 220 comprises lateral port 224 that opens into valve chamber 229 and axial port 222 that opens into valve chamber 229. In one embodiment, port 222 is considered the main valve passage and/or exterior opening because it is in fluid communication with the exterior portion of the tubing string, such as fluids existing in the annulus of the borehole. In one embodiment, lateral port 224 may align with valve opening 12 (see FIG. 1A) when the valve assembly is properly positioned adjacent to the tubing string. In one embodiment, opening 222 is located on an axial side of the valve assembly, opens into valve chamber 229, and provides fluid communication between an exterior portion of the tubing string (such as the annulus of the borehole) and the valve assembly. Depending on the intended fluid flow direction, lateral port 224 may act as the inlet port while axial port 222 may act as the outlet port or, conversely, lateral port 224 may act as the outlet port while axial port 222 may act as the inlet port. In some embodiments, port 222 may be located on a lateral side of the valve assembly instead of an axial end, such as the opposing lateral side of chamber 229. As is known in the art, valve chamber 229 may be slightly larger than valve plug 221, and one or more seals may be arranged on the plug to seal against unwanted fluid flow. In one embodiment, valve plug 221 moves within inner chamber 229 in a longitudinal direction of the valve assembly.

In one embodiment, valve section 220 comprises valve plug 221 that is coupled to power section 230 via drivetrain 234. In one embodiment, valve plug 221 may have any number of configurations, such as a dart, flat face, stepped body, or knife. In one embodiment, plug 221 is an elongated dart with head 225, tail 227, and side 223. Plug 221 may be positioned within cylindrical valve chamber 229. In one embodiment, plug 221 is configured to seal against lateral port 224 and/or axial port 222. For example, a lower end of valve chamber 229 may have a valve seat 228 (see FIG. 2B) adjacent to opening 222 that is configured to receive a portion of head 225 of the valve plug. Thus, the valve plug is positioned within the valve assembly such that its head 225 is disposed within valve chamber 229 to seal against opening 222, port 224, and valve seat 228.

In one embodiment, valve plug 221 is moveable between a substantially closed position (see, e.g., FIG. 2A) and a substantially open position (see, e.g., FIG. 2B) to open and/or close (and anywhere there between) valve assembly 214. In one embodiment, plug 221 may be actuated to close valve opening 12 (see FIG. 1A) by covering lateral port 224 and sealing against valve seat 228. Valve opening 12 can be incrementally opened by moving plug 221 off of valve seat 228 and at least partially uncovering lateral port 224 (which fluidly connects opening 222 to lateral port 224). Valve opening 12 can be moved to a substantially open position by fully moving the plug off of valve seat 228 and substantially uncovering lateral port 224. In one embodiment, the disclosed valve plug is configured to move in very small increments to give fine control over the valve assembly and fluid flow through the valve. In one embodiment, valve assembly 214 allows fine control over valve opening 12 (as well as valve assembly 214) from any position from fully open to fully closed to accommodate any injection or production scenario. For example, if desired, the valve opening may be opened to approximately 26% (or any other set point) if that is the particular opening preferred for the desired fluid flow rate. The amount of opening may be measured by any number of different attributes, such as flow rate, percentage opening of the lateral port, rotations/turns of the valve plug, or linear distance of the valve plug.

Valve plug 221 may be moved by rotation and/or linear movement of the valve plug. In one embodiment, valve plug 221 is coupled to drive shaft 234 which is coupled to motor 232. In one embodiment, the valve plug may be moved axially based on linear or rotational movement of the motor and/or drive shaft. In one embodiment, the valve plug may comprise a worm gear, ball screw, direct drive torque motor, or linear DC servo motor, each which is available to those of skill in the art. In one embodiment, drive shaft 234 extends through power section 230 and connects to motor 232. Thus, motor 232 is operatively coupled to valve plug 221 via drive shaft 234. In one embodiment, motor 232 rotates drive shaft 234 which subsequently rotates valve plug 221. In one embodiment, motor 232 is a reversible DC motor as is known in the art.

Electronics section 240 may comprise motor controller 246 and various sensors 244, such as telemetry, valve position, and electric sensors. In one embodiment, motor controller 246 is a conventional controller known to those of skill in the art and it is operatively coupled to motor 232. Controller 246 may be electrically controlled from the surface via cable 40. Controller 246 allows fine control over the motor.

Figure 2C:
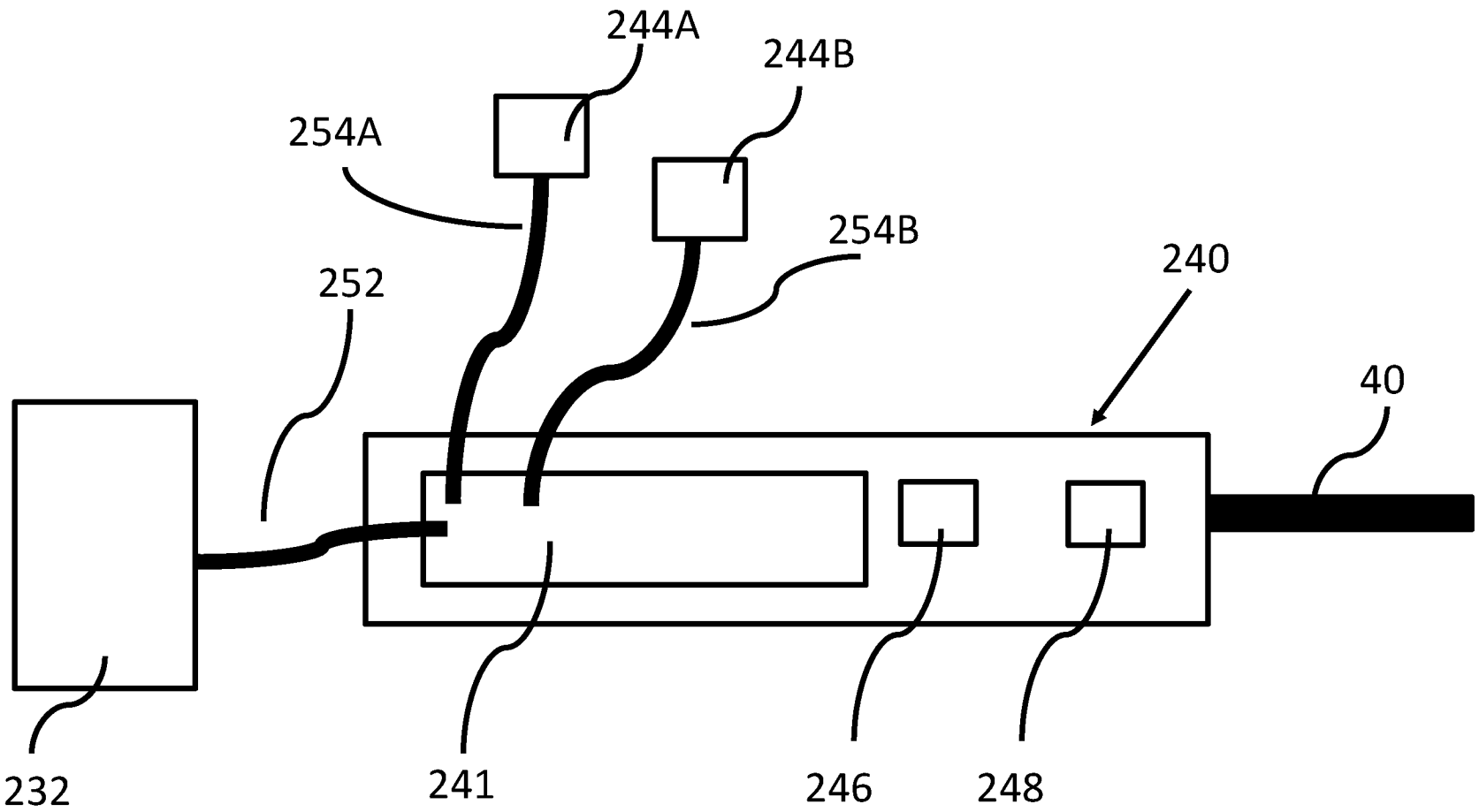
FIG. 2C illustrates a schematic view of an electronics section of a downhole valve assembly according to one embodiment of the present disclosure.

FIG. 2C illustrates a schematic view of one embodiment of electronics section 240 of the valve assembly of the present disclosure. In one embodiment, electronics section 240 is substantially similar to the electronics section disclosed in FIGS. 2A and 2B. In one embodiment, electronics section 240 comprises circuit board 241, motor controller 246, and may have integrated sensors or sensor circuitry 248. TEC cable 40 may be coupled to electronics section 240, such as by being directly coupled to control board 241, and additional valve assemblies and/or a remote surface location. Thus, operators at a remote location may communicate with and/or control the downhole valve assembly via communication over cable 40 and electronics section 240. For example, an operator may have full control of valve opening 12 and/or valve assembly 214 from the surface (or another remote location, such as a portable handheld device or computer), without entering the well and without any additional tools. Electronics section 240 may also comprise one or more integrated sensors 244A, 244B, which may be any type of downhole sensor such as pressure, temperature, and/or water cut sensors. These sensors may be located within the valve assembly or external to the valve assembly. In one embodiment, the sensors are located within a chamber of the valve assembly, internal to the tubing string, and/or external to the tubing string. In one embodiment, the sensors may comprise position sensors that provide positive feedback and known orientation of the valve assembly and/or components within the valve assembly (e.g., the position of the valve plug). In one embodiment, control board 241 is coupled to motor 232 by wires 252, and sensors 244A and 244B are coupled to control board 241 via wires 254A and 254B, respectively. In one embodiment, wires 252 and 254 are contained within valve assembly 214 such that they are not exposed to any fluids or harsh environments.

As is known in the art, communication to downhole components over a long distance is problematic with any telemetry-based technology. In other words, signals from a power supply and/or remote location over a long length provide numerous issues, such as signal conditioning. Necessary software and user interface (UI) may be necessary, as is known in the art, to push power (TX) and receive data (RX) from a downhole valve to the surface at distances over 5000 km. The present disclosure allows real-time data communications and/or power to be transmitted to a plurality of downhole valves via a single electrical cable over distances over 5000 km and avoids numerous signal conditioning issues existing in the prior art. Using the appropriate user interfaces, the downhole valves and valve positions may be controlled from the surface or any other remote location. For example, any remote location can query the sensors for data and diagnostics for each valve. Further, the necessary control system and software allow for automation and control of the valves and valve positions based on real-time downhole conditions.

Figure 3A:
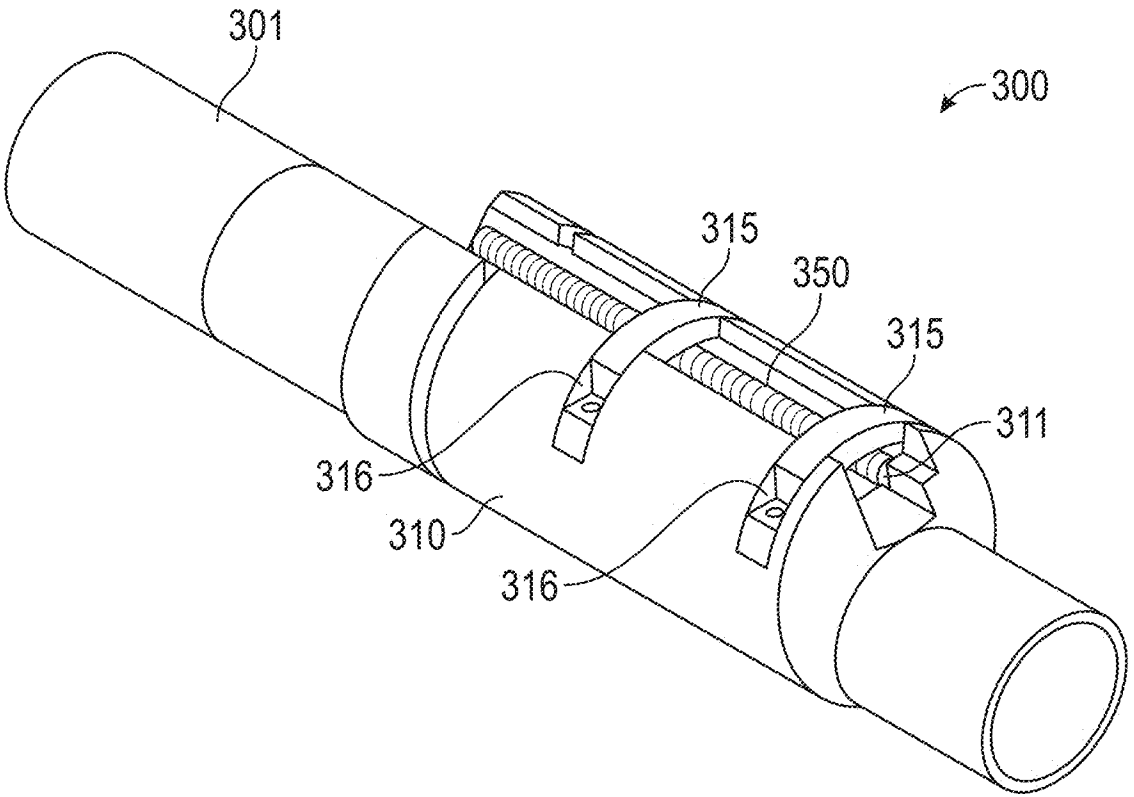
FIG. 3A illustrates a perspective view of a downhole valve assembly according to one embodiment of the present disclosure.
Figure 3B:
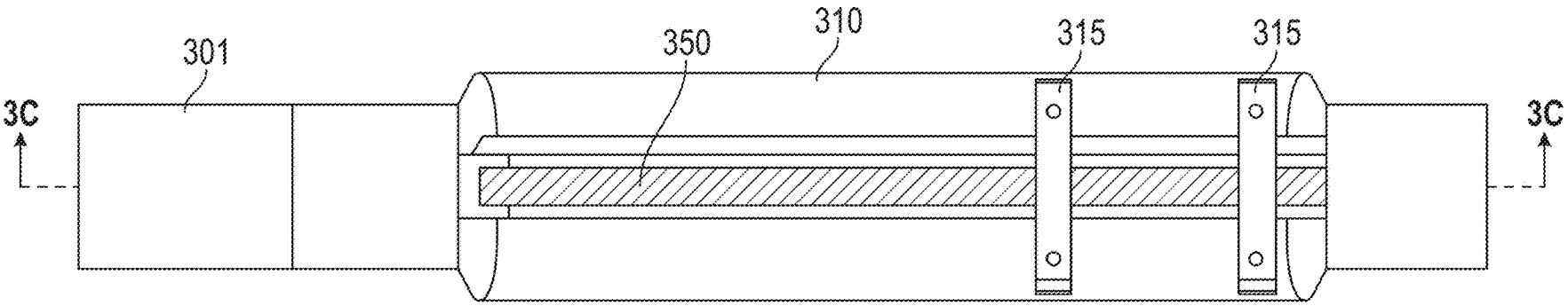
FIG. 3B illustrates a top-plan view of the embodiment from FIG. 3A.
Figure 3C:
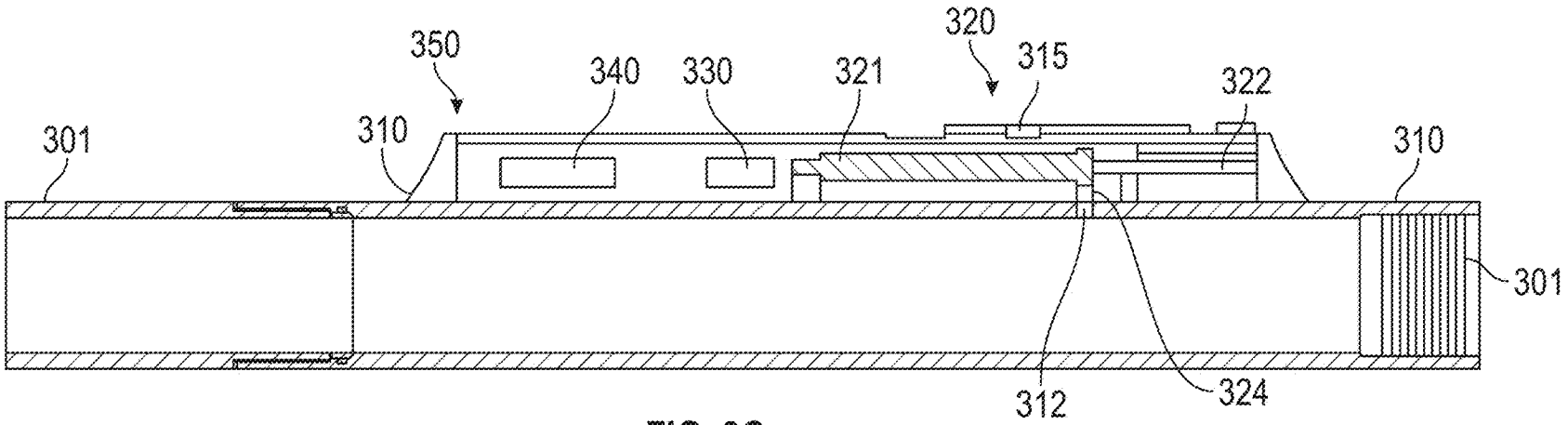
FIG. 3C illustrates a cross-sectional view along line 3C in FIG. 3B.

FIGS. 3A-3C illustrate various views of a valve assembly system according to one embodiment of the present disclosure. In particular, FIG. 3A illustrates a perspective view of one embodiment of the present disclosure showing a valve assembly coupled to a tubing sub, FIG. 3B illustrates a top-plan view of the embodiment from FIG. 3A, and FIG. 3C illustrates a cross-sectional view along line 3C in FIG. 3B.

In one embodiment, downhole valve system 300 comprises a valve assembly coupled to an offset tubing sub. For example, as illustrated in FIGS. 3A and 3B, valve assembly 350 may be coupled to offset tubing sub 310. In one embodiment, valve assembly 350 may be substantially similar to valve assemblies 14 and/or 214. As discussed above, tubing sub 310 may be configured to be placed in line with tubing string 301, and may be considered an offset sub or mandrel. As is known in the art, a tubing sub may have threaded ends (which may form a tubing coupling) which match the threads of the lengths of jointed tubing. For example, tubing sub 310 may have threaded ends which couple with threaded ends of tubing string 301. In other embodiments, the disclosed valve assembly may be coupled to other downhole tools or equipment, such as production liners, slotted liners, and coiled tubing. In one embodiment, the tubing sub may have a plurality of different diameters. For example, the threaded ends of the tubing sub may have a diameter that is substantially similar to a diameter of the tubing string, while a central portion of the tubing sub (where the valve is installed) may have a diameter that is larger than the diameter of the adjacent tubing string. In one embodiment, the diameter of the tubing string may be between 2-7 inches, such as approximately 2¾" tubing. In one embodiment, the tubing sub may have a length of approximately 16". In one embodiment, the tubing subs are coupled to the jointed tubing at the surface prior to insertion into the well; likewise, the valve assemblies are coupled to the tubing subs and a TEC cable is attached to each of the valve assemblies as the corresponding tubing section is inserted downhole. As illustrated in FIG. 1B, in one embodiment, a plurality of tubing subs and valve assemblies are provided along the length of the tubing string at different intervals, and a single TEC cable may be used to control all of the valve assemblies. In some embodiments, the tubing subs (and downhole valves) may be different sizes and/or diameters depending on their location on the tubing string.

Valve assembly 350 may be coupled to tubing sub 310 in any number of arrangements and by a variety of attachment mechanisms. In one embodiment, tubing sub 310 comprises trough or channel 311 that runs parallel to a long axis of the tubing sub. Trough 311 is configured to receive valve assembly 350 within the channel and to couple the valve assembly to the tubing sub and/or tubing string. Electrical cable 40 and various sensors may also be positioned within the channel and/or adjacent to the valve assembly when coupled to the tubing sub. On either side of the trough may be located recesses 316 which allows one or more attachment devices to securely couple the valve assembly to the tubing sub and within the channel. In one embodiment, a plurality of securing brackets or clamps 315 attach the valve assembly to the tubing sub. In one embodiment, two brackets 315 (see FIG. 3B) are used to attach the valve assembly to the tubing sub, although more or less may be utilized. A portion of each securing bracket 315 may be received into recesses 316 on either side of channel 311. In one embodiment, a small gap is located between valve assembly 350 and tubing sub 310, which allows cable to run alongside the valve assembly and be secured by the securing bracket. Of course, the disclosed valve assembly may be securely attached to the tubing string and/or tubing sub by a wide variety of attachment mechanisms besides securing brackets 315. For example, openings and/or locks may be disposed on an inside surface of the channel that couple with corresponding surfaces of the valve assembly. In other embodiments, clamps, pins, latches, or welds may be used to securely couple the valve assembly to the tubing sub.

The disclosed valve is well suited for small to large diameter tubing and annular spaces. In one embodiment, the unique configuration of the tubing sub, valve assembly, and coupling means between the tubing sub and valve assembly allow use of the valve assembly in small spaces, such as a 2⅜" diameter tubing in 4" casing (or even smaller). This compact configuration is substantially better than conventional valve designs. As one example, the disclosed valve assembly configuration does not affect the internals of the tubing string. For example, as compared to conventional valve technologies, the disclosed valve does not affect the internal diameter of the tubing, and thus may be used for smaller diameter pipe than traditionally possible. Of course, the valve can be scaled up for additional pipe sizes, such as up to 7" ID. However, in general, the disclosed valve may be used with any size tubing and casing.

As illustrated in FIG. 3C, tubing sub 310 may have an opening located on a wall of the tubing sub, which allows fluid to enter or exit the interior of tubing string 301. In one embodiment, valve opening 312 is located on a wall pipe surface of tubing sub 310 within channel 311. In one embodiment, a corresponding opening on valve assembly 350 is positioned adjacent to valve opening 312 to allow fluid flow between valve assembly 350 and the inside of tubing string 301 and/or tubing sub 310 and between the annulus of the tubing string and the interior portion of the tubing string.

As illustrated in FIG. 3C, valve assembly 350 may comprise electronics section 340, power section 330, and valve section 320. In one embodiment, valve section 320 comprises main passage/opening 322, lateral port 324, and valve plug 321. In an assembled configuration of the valve assembly and the tubing sub, lateral port 324 is adjacent to valve opening 312. In one embodiment, valve plug 321 comprises an elongated dart, with a head portion and a shaft portion, that is coupled to power section 330. In one embodiment, such as for fluid production from tubing string 301, main passage 322 functions as an outlet and lateral port 324 functions as an inlet for the valve assembly; in other embodiments, such as for well injection, main passage 322 functions as an inlet and lateral port 324 functions as an outlet for the valve assembly. As described herein, each of the openings 322 and 324 may have different configurations and be located at different positions within valve assembly 350 Likewise, dart 321 may have different shapes and be in communication with openings 322 and 324 based upon the different valve assembly configurations.

Figure 4A:
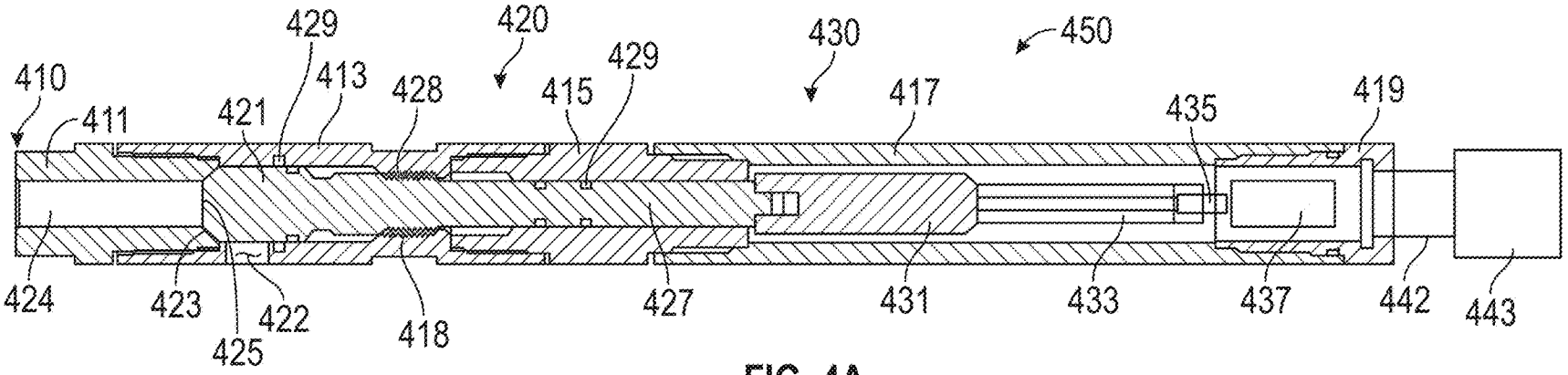
FIG. 4A illustrates a cross-sectional view of a valve assembly in a substantially closed position according to one embodiment of the present disclosure.

FIG. 4A illustrates a cross-sectional view of valve assembly 450 in a substantially closed position according to one embodiment of the present disclosure. In one embodiment, valve assembly 450 may be substantially similar to valve assembly 350. In one embodiment, valve assembly 450 may comprise valve section 420 and power section 430. In one embodiment, electronics section 443 (which may be internal or external to the inner housing cavity of the valve assembly) may be coupled to power section 430. In one embodiment, valve assembly 450 may comprise housing 410 that is formed of multiple housing elements threaded together to form a generally cylindrical cavity within the housing. For example, housing 411 may comprise main passage housing 411, valve body housing 413, dart shaft housing 415, drive housing 417, motor housing 419, and electronics housing 443. In some embodiments, the electronics section and the motor are located within the same chamber or housing. Main passage housing 411 comprises main passage 424 in an axial portion of the housing that enters inner cavity 426 (see FIG. 4B) and valve body housing 413 comprises lateral port 422 in a side portion of the housing. Valve body housing 413 and shaft housing 415 are threaded together to form valve chamber/cavity 426. Within valve chamber 426 is located valve plug 421.

Valve plug 421 may be an elongated dart, with dart head 425 and dart shaft 427. Dart 421 is positioned within the valve assembly such that its head portion 425 is disposed within valve chamber 426 and seals against lateral port 422, main passage 424, and/or valve seat 423. In one embodiment, the contact surfaces of valve seat 423 and head 425 must sealing mate to prevent fluid flow. One or more sealing systems 429 (e.g., O-rings) may be provided at various points along the dart, such as external portions of the dart and/or internal portions of the shaft housing 415, to ensure that fluid which passes through the valve is isolated substantially within valve chamber 426. Suitable seals may be fashioned from any suitable elastomer or polymer, as is well known in the art. In one embodiment, a washer element (not shown) may be provided around valve seat 423 to improve the valve seal at that position. The washer may comprise a nylon or Teflon™ material, and may be impregnated with a material (such as molybdenum) to improve mechanical strength.

In one embodiment, dart 421 may comprise a worm gear for actuation of the dart within the valve housing. For example, the worm gear may have a helical thread portion 428 on an external surface of dart shaft 427, which mates with an internal thread portion 418 formed on the inside of valve housing 413. As may be appreciated by those skilled in the art, rotation of dart 421 causes it to move axially within the valve body as a result of the worm gear. Accordingly, dart 421 may be actuated to close a valve opening in a tubing sub (or other portion of the tubing string) by covering lateral port 422 and sealing against valve seat 423 with dart head 425. Conversely, moving dart 421 to open the valve can be performed by moving dart head 425 off the valve seat and at least partially uncovering lateral port 422, which opens up fluid communication between main passage 424 and lateral port 422. In other embodiments, the worm gear may be located on other portions of the valve plug. In still other embodiments, a worm gear may not be utilized. As one example, a ball screw may be used instead of a worm gear; a ball screw is a more efficient rotational power transfer but adds increased manufacturing complications. As another example, a linear DC motor (as opposed to a direct drive torque motor) actuates without rotation (e.g., it is a direct shaft shift); thus, a worm gear or other rotational to linear mechanism is not needed.

Power section 430 may comprise one or more drive shafts coupled to a motor or other actuator. For example, motor 437 may be located within an inner cavity of valve assembly 450, and a portion of the motor (such as motor bushing 435) may be coupled to second drive shaft 433 which is coupled to first drive shaft 431 which is coupled to valve plug 421. First drive shaft 431 may comprise an end with a female spline that is coupled to a portion of second drive shaft 433 with a male spline. In other embodiments, only a single drive shaft may be utilized. For example, use of a different type of motor (such as a linear DC motor) may not require the use of multiple drive shafts.

Thus, in one embodiment, dart shaft 427 connects (directly or indirectly) to motor 437. Motor 437 fits within valve assembly housing 410, such as within motor housing 419, and rotates the dart. In one embodiment, the motor is preferably a small reversible DC motor, but may be any other conventional actuator. While not specifically illustrated in FIG. 4A, the valve assembly may comprise additional electronic components within housing 415, such as a motor controller and circuit board (see, e.g., FIGS. 2A, 2C). In one embodiment, a conventional motor controller is operatively connected to the motor and may be controlled from the surface, as described herein, or any other remote location. Further, as illustrated in FIG. 4A, one or more telemetry sensors 443 may be located external to the valve body housing 410 and coupled to the electronics system within the valve assembly via wires 442. In some embodiments, the sensors may be positioned within the valve assembly itself or adjacent to one of the ports 422, 424.

Figure 4B:
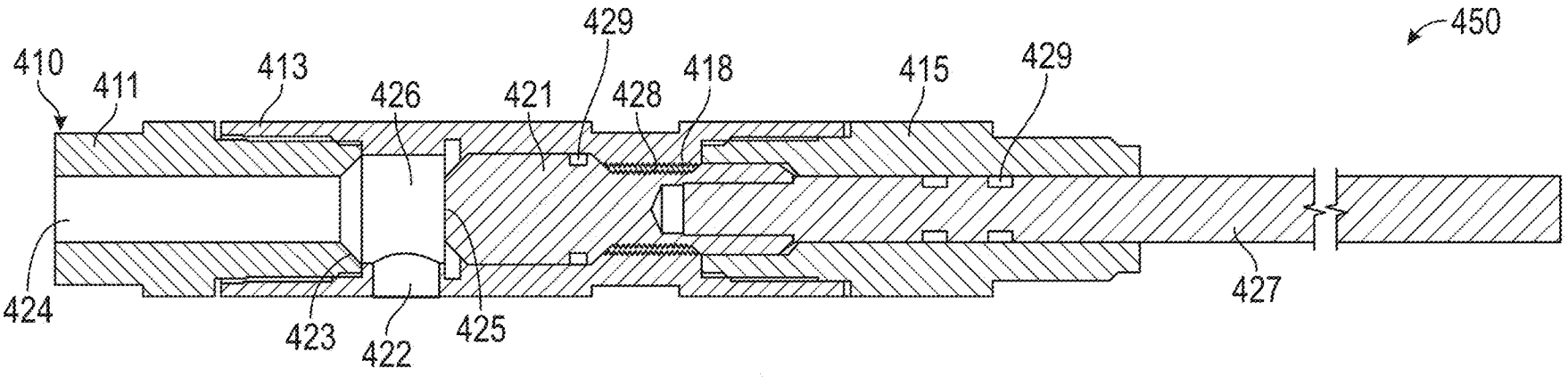
FIG. 4B illustrates a cross-sectional view of a valve assembly in a substantially open position according to one embodiment of the present disclosure.

FIG. 4B illustrates a cross-sectional view of the valve assembly from FIG. 4A in a substantially closed position according to one embodiment of the present disclosure. For simplicity purposes, portions of the valve assembly illustrated in FIG. 4A are not shown or numbered in FIG. 4B. FIG. 4B shows the valve assembly in a substantially open position because the valve plug (or dart) 421 does not cover lateral port 422 and allows fluid to fully flow between lateral port 422 and main passage 424. Of course, the valve plug may be partially opened and/or closed such that lateral port 422 is only partially blocked.

Figure 5:
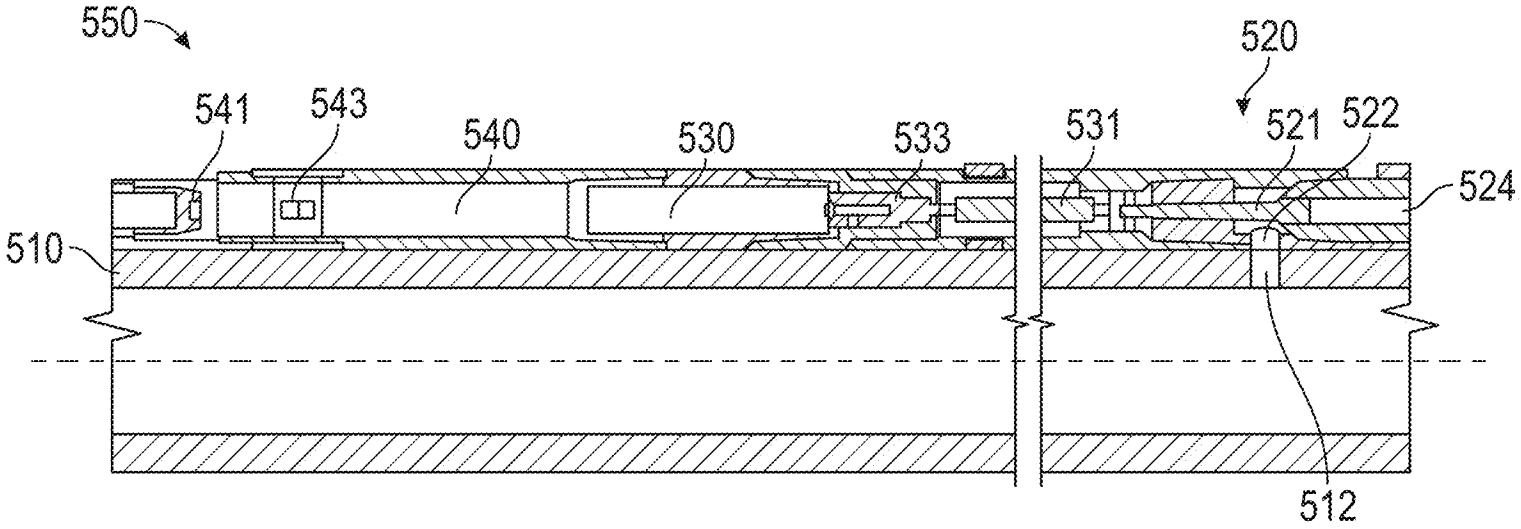
FIG. 5 illustrates a cross-sectional view of a valve assembly coupled to a tubing sub according to one embodiment of the present disclosure.

FIG. 5 illustrates a cross-sectional view of valve assembly 550 coupled to tubing sub 510, according to one embodiment of the present disclosure. Valve assembly 550 may be substantially similar to valve assemblies 350 and 450. In one embodiment, the tubing sub comprises valve opening 512 in a surface of a wall of the tubing sub, which may be positioned adjacent to a portion of the valve assembly for fluid communications between the valve assembly and valve opening 512. In one embodiment, valve assembly 550 comprises electronics chamber 540, motor 530, and valve section 520. Valve body housing may comprise lateral port 522 and axial port 524 in portions of the housing wall. In one embodiment, lateral port 522 is arranged substantially adjacent to valve opening 512 in tubing sub 510. In one embodiment, valve plug 521 blocks fluid flow from lateral port 522 to axial port 524, and thus blocks fluid flow through the valve assembly. As in other embodiments in the present disclosure, valve assembly 550 comprises one or more drive shafts that couple motor 530 to valve plug 521. In one embodiment, two drive shafts 531, 533 are utilized with corresponding male and female spindles. For example, first drive shaft 531 is coupled to valve plug 521, while second drive shaft 533 is coupled to motor 530 and first drive shaft 531. A plurality of sensors may be integrated within the valve assembly. In one embodiment, a first pressure and temperature sensor 541 is positioned to measure the annular tubing pressure (and temperature), and a second pressure and temperature sensor 543 is positioned to measure the internal tubing pressure (and temperature). Each of these sensors may be located internal or external to electronics section 540 and/or the valve assembly, and the measurements from the sensors is sent to the electronics section 540 for input to the associate control logic and/or to a remote location (e.g., the surface) for monitoring by an operator.

As described herein, the disclosed valve assembly utilizes a drive system that moves the valve plug between a plurality of valve positions. The drive may be any number of available drive train systems, including a ball screw, lead screw, worm gear, direct drive torque motor, linear motor, DC motor, and other actuators as is known in the art. In one embodiment, the motor is an electric motor as opposed to a pneumatic or hydraulic motor. In one embodiment, the motor may be linear or rotary, and may provide high precision, finite movements of the valve plug. In one embodiment, a linear DC servo motor is utilized that comprises a solid stator housing, a coil assembly, and a multipole magnetic forcer rod.

The configuration of the inlet and outlet ports for the valve assembly—and their interaction and/or sealing surface with the valve plug—may take a number of different embodiments. While one embodiment discloses a dart that seals against a lateral port and an axial port (see, e.g., FIG. 4A), other configurations are possible within the scope of this invention based upon the intended operation/use of the valve, certain downhole conditions, and/or valve plug design.

In general, the disclosed valve plug may be any flow control member that blocks the inlet and outlet ports and/or is moveable to close and/or open the valve. In one embodiment, the valve plug functions to partially and/or fully seal fluid flow through the valve assembly. This function can be met by any number of different configurations of the valve plug.

In one embodiment, the valve plug may be an elongated dart, which has a head portion (which may be considered as the dart tip) and a tail portion (which may be considered as the dart shaft). In one embodiment, the valve plug operates as a flow control member and the disclosed valve is a flow control valve. In other embodiments, the valve plug may be a needle valve, a ball valve, or a knife valve. The dart may generally comprise a head section and a tail section. In one embodiment, the tail section may be a shaft that is coupled directly or indirectly to a motor or drive train. The head section of the valve plug may seal against one or both of the inlet and outlet ports to the valve assembly. The dart may have one or more threaded sections and may comprise a worm gear and/or a ball screw. In one embodiment, the dart may have one or more sealing systems (e.g., O-rings) on a shaft portion of the dart and/or the head portion of the dart. In one embodiment, the dart tip or head mates with a sealing face of the valve housing that surrounds an exterior passage or opening to the valve assembly, which may be considered the valve seat. To prevent fluid flow through the main passage (and to regulate flow through the main passage) and to position the valve in a substantially closed position, the contact surfaces of the dart tip must sealing engage with the valve seat. Such a sealing arrangement may be performed by any number of different arrangements, including different faces, shapes, and materials of the dart tip and the corresponding valve seat. The head portion of the valve plug may have various configurations, including substantially flat and/or angled sealing surfaces. In these embodiments, the main passage is an axial port and the lateral port is not illustrated. Further, the valve plug may interact with the inlet and outlet openings to the valve assembly by different mechanisms. In one embodiment, the valve plug may be larger than the exterior passage to the valve, and in other embodiments, the valve plug may be the same or smaller diameter than the exterior passage.

The valve plug can be formed of a wide variety of materials. For example, the dart may be made of both metallic and non-metallic materials. For example, a shaft portion of the dart may be substantially metallic (e.g., stainless steel), and the head portion of the dart may be substantially plastic, such as any number of thermoplastics or elastomers. In other embodiments, the head portion may be a different metallic material (e.g., brass or Inconel) than the shaft portion. In some embodiments, the dart tip may be substantially non-metallic and the valve seat may be substantially metallic, while in other embodiments the dart tip may be substantially metallic and the valve seat may be substantially non-metallic, while in still other embodiments both the dart tip and valve seat may be substantially metallic or non-metallic.

While the previously described downhole valve is one embodiment of a valve according to one embodiment of the present disclosure, it should be recognized that this invention is not necessarily limited to such a valve. Other valves may similarly be used with the disclosed processes and methods described herein.

Operation

In one embodiment, the disclosed valve assembly may be used to monitor and/or control any injection and/or production operation of a downhole operation. In one embodiment, multiple valve assemblies may be remotely controlled downhole via a single control line connecting each of the valve assemblies. Injection or stimulation operations may include, but are not limited to, enhanced oil recovery (EOR), carbon dioxide ($CO_2$) injection, artificial gas lift, and automated oil and gas production. Production operations may include optimizing the flow of oil and/or gas through various downhole valves placed between stimulated intervals in zones or compartments (such as those separated by packers). For example, the disclosed valve may be configured to detect water flowing through the valve assembly and thus in certain embodiments can shut off water producing compartments to keep oil or gas production flowing to the surface. In the inverse operation, such as for an EOR scenario, the disclosed valve assembly may be configured to inject water, gas, or oil into a particular compartment (such as one separated from other zones or compartments by one or more packers) effectively by shutting off over injected compartments by the detection of water break through. The disclosed valve allows for injection into or production from the tubing string, and thus reverse fluid flow operations may be performed without a workover.

In one embodiment, the determination of which valve to inject the desired fluid into is derived by the pressure and temperature sensors located within the valve assembly, whether they are located on the inner diameter or the outer diameter of the valve. This sensor data provides the valve assembly and/or remote operator the ability to sweep or inject the desired fluid (e.g., water, gas, carbon dioxide) into the desired zone and at what total percentage. Similarly, artificial lift operations may include placing the desired number of valve assemblies (such as up to 30) along the tubing string within the production casing. Each valve may be open and/or closed based on pressure measurements by sensors within the valve assembly. In one embodiment, each of these disclosed operations, and in particular the artificial lift operation, is based on logic within the valve assembly and the sensor measurements derive the position of the valve inlet and/or outlet.

Figure 6:
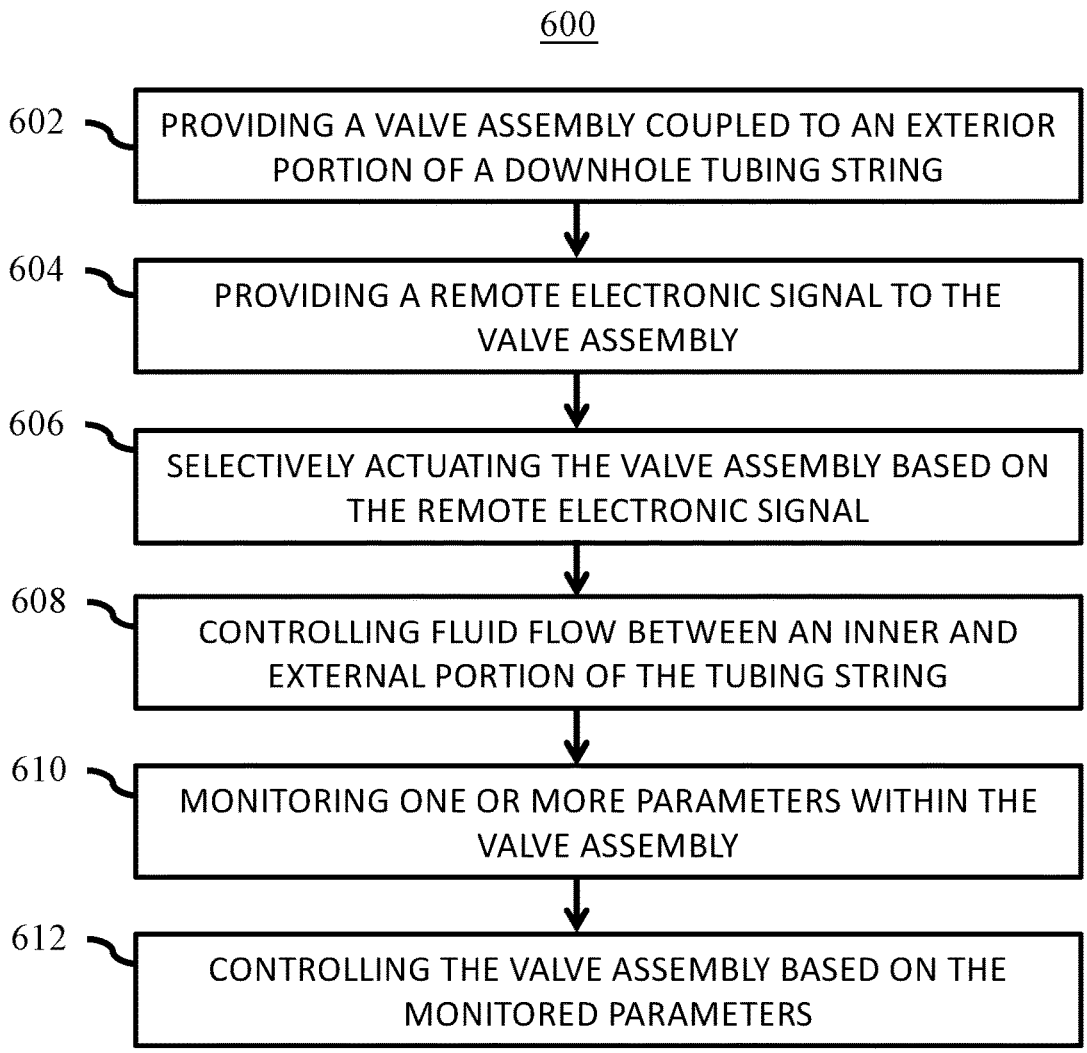
FIG. 6 illustrates one method for operating a downhole valve according to one embodiment of the present disclosure.

FIG. 6 illustrates one exemplary method 600 to operate a downhole valve as disclosed herein. The method may be utilized in any injection or production operation as described herein. Step 602 comprises providing a valve assembly coupled to an exterior portion of a tubing string. In one embodiment, the valve assembly may be coupled to a tubing sub or mandrel which is coupled to the tubing string by threaded joints. In one embodiment, the valve assembly is coupled to an exterior portion of the mandrel (see, e.g., FIG. 3A). The valve assembly may be in fluid communication with an interior portion of the tubing string. The valve assembly may comprise a first port (such as a lateral port) in fluid communication with an inlet opening to the tubing string and a second port (such as an axial port) in fluid communication external to the tubing string (such as an annulus of the borehole). In other embodiments, a production liner, slotted liner, or coiled tubing may be utilized instead of a tubing string.

Step 604 comprises providing a remote electronic signal to the valve assembly. In one embodiment, the valve assembly is coupled to a TEC cable (which may be coupled to other downhole valves positioned on the tubing string) that connects the valve assembly to a remote location, such as at the surface to the borehole. Such a surface station may provide data and/or power to the TEC cable and thus to the valve assembly. The surface station may be coupled to a wireless system that allows further data transmission with the valve assembly for further remote operation, control, and/or monitoring. For example, an operator may be able to remotely control signals to the valve assembly via any remote device, such as a handheld device, smart phone, computer, or any other Internet enabled device. The remote electrical signals may comprise commands to the valve assembly or data from the valve assembly in response to various sensors or other signals from the valve assembly. In one embodiment, the valve assembly comprises an electronics section with the necessary control boards and motor controllers that can receive any data and/or electronic commands from a remote location to control the valve assembly. Thus, the valve assembly may be electronically activated and controlled from the surface without having to enter the well with any additional tools. While a portion of the operations of the downhole valve assembly may be performed automatically and/or independent within the electronics of the valve assembly itself, some of the target points or control points may be provided by the remote location.

Step 606 may comprise selectively actuating the valve assembly based on the remote electronic signal. In one embodiment, a particular valve within a plurality of valves may be individually controlled. In one embodiment, actuation of the valve assembly comprises moving the valve plug (e.g., dart) axially the desired distance to open or close either (or both) the inlet and outlet ports of the valve assembly. In one embodiment, axial movement of the dart is caused by rotation of one or more drive shafts within the valve assembly that are coupled to the dart. In one embodiment, remote signals from the surface may be communicated to a motor controller or control board of the valve assembly, which then may be communicated to a motor of the valve assembly for actuation of the valve assembly. In one embodiment, the valve assembly is able to react near instantaneously to surface (remote) commands. As described herein, the valve assembly may be actuated between a closed position and an open position (and vice versa), and any position between a substantially open and closed position. For example, if the valve assembly wanted to be open to set point of 26%, the valve could be actuated (whether opened or closed) until the valve assembly is open 26% as measured by an electronic encoder. Of course, other set points between 0% to 100% may be achieved. In one embodiment, the valve assembly may be selectively actuated to a certain parameter, whether that parameter is flow rate, temperature, pressure, and/or valve position.

Step 608 may comprise controlling the fluid flow between an internal portion or cavity of the tubing string and an external portion of the tubing string. For example, as described herein, a valve assembly may be coupled to a tubing sub with a valve opening that is coupled to a downhole tubing string. Thus, the valve assembly controls fluid flow between the inner portion of the tubing string and the outer portion of the tubing string at a location proximate to the valve assembly. Actuation and/or control of the valve assembly controls an opening within the valve assembly which thereby controls fluid flow through the valve opening. In one embodiment, one of the passages/openings of the valve assembly is in fluid communication with an exterior portion of the tubing string, such as the annulus of the borehole. Thus, control of the valve assembly allows fluid flow control between the annulus of the tubing string and the inner portion of the tubing string. Such a configuration of the disclosed valve assembly allows a wide variety of downhole fluid operations, such as injecting fluid into the tubing string through the annulus or into the annulus from the tubing string, or producing fluids from the tubing string out through the valve assembly and vice versa.

In some embodiments, step 610 may comprise monitoring one or more parameters within the valve assembly. For example, any one or more downhole parameters may be monitored, such as flow rate, temperature, pressure, and/or valve position. In one embodiment, the valve assembly may comprise one or more integrated sensors that detects one or more downhole parameters and then sends electrical signals through a TEC cable up to the surface and/or other remote location. During the operation of the valve assembly, parameters can be continually monitored in real-time for each valve assembly and communicated to a remote location via the TEC cable. Thus, an operator may be able to view (in real time) zonal fluctuations within the borehole as the occur and take corrective and immediate action by selective control of a particular valve. In some embodiments, the valve assembly may be configured to automatically regulate and/or control itself based on the measured parameters, with or without remote electronic signals. In one embodiment, the valve assembly (via one or more sensors) provides positive feedback and known orientation of the valve. In some embodiments, the sensors may be located within the valve assembly itself or merely adjacent to the valve. Likewise, the sensors may measure a parameter inside of the valve assembly, exterior to the tubing string, or interior to the tubing string.

In some embodiments, step 612 may comprise controlling the valve assembly based on any signals received in response to the monitoring step. For example, if a particular fluid flow rate is desired, the valve may be opened to a certain initial valve position. A valve assembly sensor may measure the flow rate through the valve based on this initial valve position and then automatically move and/or control the valve to a different valve position to achieve the desired fluid flow rate. Such control may be performed within the valve assembly itself with the necessary control logic programming without having to send signals back and forth between a remote location. In other words, once a particular parameter is set for the valve assembly, the valve assembly is configured to achieve that parameter for the desired time or until a different parameter is provided. Thus, in one embodiment, the disclosed valve assembly is able to provide continuously variable flow control based upon real-time measured data. In one embodiment, if water or gas is detected in the fluid flow (or if some other desired parameter is measured), the valve assembly may be programmed to automatically close to reduce the unwanted fluid.

As disclosed herein, multiple downhole valves may be coupled to a single control line and actuated, controlled, and/or monitored by a remote location. In such an embodiment, each of the downhole valves may be used independently similar to those steps described above in relation to method 600. In other words, while method 600 is generally related to a single valve, such steps are equally related to the use of a plurality of downhole valves as described herein.

Figure 7:
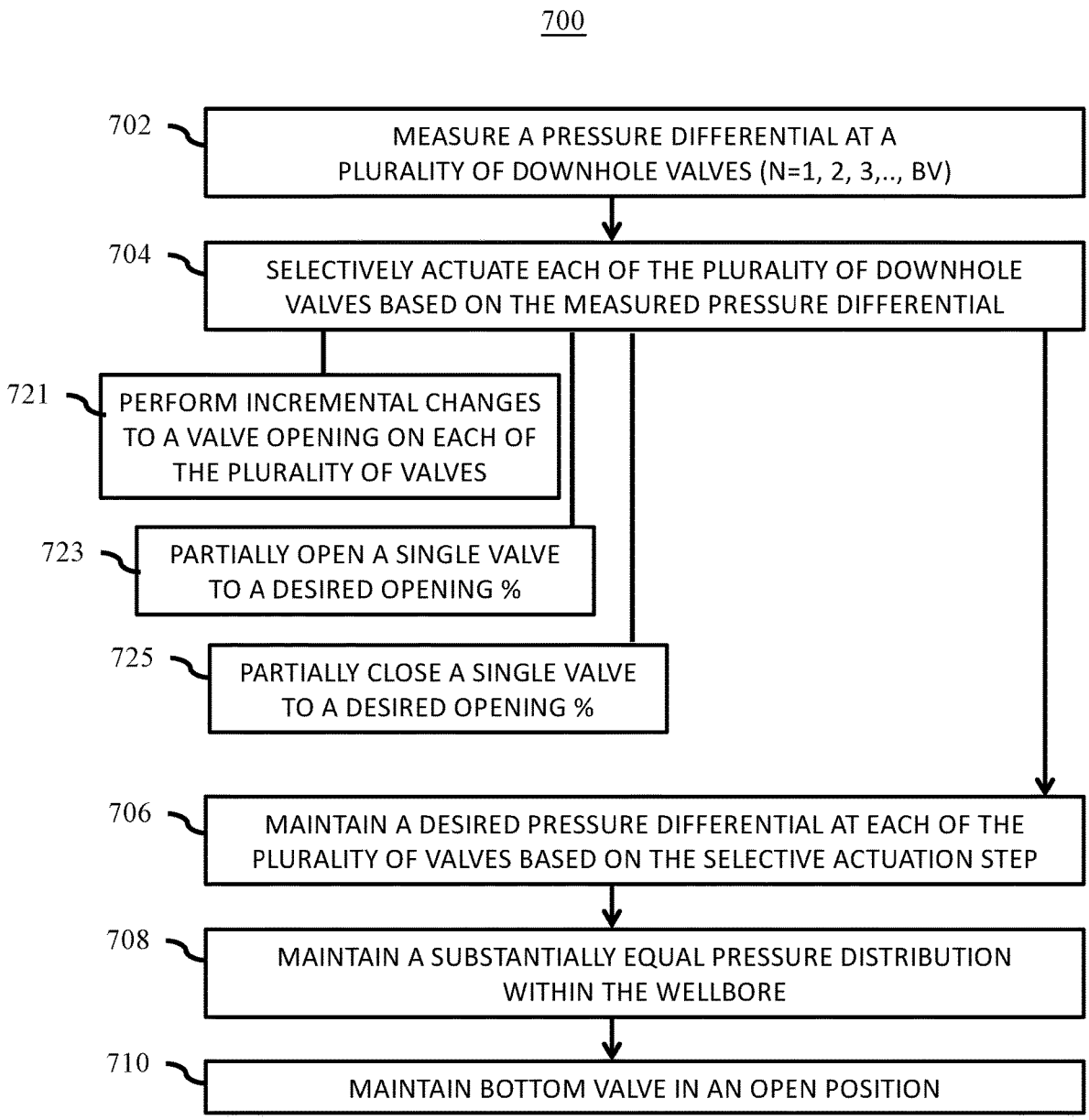
FIG. 7 illustrates one method for operating a plurality of downhole valves according to one embodiment of the present disclosure.

FIG. 7 illustrates one exemplary method 700 to operate a plurality of downhole valves as disclosed herein. The method may be utilized in any injection or production operation as described herein. In one embodiment, method 700 is substantially similar to method 600, but method 600 is directed to an individual valve and method 700 is directed to a plurality of valves. In one embodiment, the steps may be performed for a gas-lift operation. In one embodiment, method 700 comprises maintaining a substantially equal pressure distribution within the wellbore by the selective actuation of a plurality of downhole valves.

Step 702 comprises measuring a pressure differential at a plurality of downhole valves. In one embodiment the plurality of valves may be coupled to a tubing string, such as via a mandrel or tubing sub as disclosed herein. The valves may be numbered from N=1 (at the top) and successively down N=2, N=3, N=4, etc., while the bottom valve is N=B V. In one embodiment, each valve has an inside pressure sensor and an outside pressure sensor such that a pressure is measured inside and outside of the tubing string, and the difference of such measurements may be considered a pressure differential. Such a pressure differential provides an indication of the pressure distribution within the wellbore and the effectiveness of the particular injection or production operation at that particular valve location. In one embodiment, it may be desirable for a gas-lift operation to have less than a 10% pressure differential. Such pressure measurements may be automatically measured and monitored and provided in real-time to a remote control system and/or a remote operator. In other embodiments, additional downhole parameters within each of the plurality of valves may be measured, such as temperature and flow rate.

Step 704 comprises selectively actuating each of the plurality of valves based on the measured pressure differential. Such an actuation signal may be provided locally (based on control logic within the valve itself) or remotely such as by a remote electronic signal (itself which may be provided manually or automatically). The remote electronic signal may be provided to the valve by a hard wire (such as a TEC cable as described herein) or by wireless mechanisms. In one embodiment, the actuating step may be based on measuring step 702. For example, when a desired pressure differential is met at a particular valve (such as 10% or 100 PSI), the valve may be partially opened, partially closed, fully opened, or fully closed, as appropriate. In one embodiment, only one of the plurality of downhole valves is opened at a time while the remaining valves stay closed. In other embodiments, one or two of the plurality of downhole valves are selectively opened or closed while the remaining valves stay closed. In still other embodiments, a plurality of valves may be selectively opened or closed as necessary to perform the desired operations. Steps 721, 723, and 725 illustrate various actuation steps which may be performed as part of and/or in conjunction with the selective actuation step 704. In one embodiment, incremental changes may be performed for an individual valve to open or close a valve opening within the valve, as illustrated in step 721. Such incremental changes may include changes to a percentage open of the valve or a number of turns of a valve member within the valve. Such changes may be based on pressure points, and may also be based on time. For example, once a particular pressure set point has been reached, the valve may be opened 5% every 5 minutes. As an alternative, once the valve is opened to a particular opening percentage (such as 20%), the valve may be incrementally opened to 50% or 100% by 5% or 10% opening steps every 5, 15, or 30 minutes, as just one example. Of course, one of skill in the art will realize that many other combinations are possible. As illustrated in steps 723 and 725, a particular valve may be selectively opened or closed to a desired opening percentage with or without incremental changes to that valve opening percentage.

Step 706 comprises maintaining a desired pressure differential at each of the plurality of valves based on the selective actuation step. For example, a desired pressure differential may be targeted as between 5-25%, such as approximately between 5-10%. In one embodiment, the pressure differential is adjusted by controlling fluid flow into or out of the tubing string based on the actuating steps. In other words, selectively opening and closing a particular valve or combination of valves regulates the pressures at the respective valves. If a target pressure differential is desired, various steps may be performed to adjust one or more valves.

Step 708 comprises maintaining a substantially equal pressure distribution within the wellbore. In one embodiment, such a step may be based on the selective actuation step 704. In general, a substantially equal or consistent pressure distribution is desired within the wellbore. In one embodiment, a pressure distribution may be considered equal if there is less than 20% variation of the pressures at a given point, such as between 5-10%. In one embodiment, each of the plurality of valves may be selectively actuated in an orderly fashion to generate a substantially equal pressure distribution within the wellbore at the relevant valve locations. In one embodiment, the substantially equal pressure distribution may be performed within a certain zone of the wellbore (such as at a first plurality of valves) or within the entire wellbore itself.

Step 710 comprises maintaining a bottom valve of the wellbore in an open position, such as approximately 100% open. This is particularly helpful in gas-lift operations, where gas is injected into the tubing string and after initialization and/or stabilization of the wellbore with the injected gas, the lowest/bottom valve of the wellbore is maintained in a fully open position to inject the gas into the well to maintain the desired pressure differentials within the wellbore and to maintain a substantially equal pressure distribution within the wellbore.

One of skill in the art will recognize that for some operations, the bottom valve may not be fully opened, or that to create a substantially equal pressure distribution within the wellbore one or more of the plurality of downhole valves may need to be re-opened and/or re-closed to maintain the desired pressure distributions within the wellbore. Further, each of the valves is able to partially open and/or partially close to maintain the desired pressure distributions at each valve and within the wellbore.

Gas-Lift Operations

In one embodiment, the disclosed downhole valve may be used in gas-lift operations. The gas-lift operations may be similar to the steps described in relation to FIGS. 6 and 7. Other valves besides the valve embodiments described herein may likewise be used based on the teachings of the below system and methods for gas-lift operations. For example, in one embodiment, any valve that allows incremental control over an individual valve by a remote location may be used, which allows for partial or full opening and closing of an individual valve based on one or more parameters, such as pressure differential.

In one embodiment, disclosed is an artificial lift system and method that utilizes a plurality of valves positioned along the tubing string within the production casing. The plurality of valves may be used for a gas-lift operation to inject gas into the tubing to produce fluid from the annulus, or to inject gas into the annulus to produce fluid from the tubing. In one embodiment, more than 30 valve assemblies may be electrically connected to a surface location via a single electronic control line. In one embodiment, less than 10 valves may be used. Each valve may be opened and/or closed based on pressure measurements by sensors within the valve assembly. In one embodiment, the artificial lift operations may include initiation of a well for gas injection, monitoring pressure fluctuations to create a substantially balanced pressure distribution within the well, slug flow control, and well depletion operations. In one embodiment, the gas-lift method may include opening the plurality of valves, one at a time, to create a balanced pressure distribution within the tubing string to initiate and/or enhance gas-lift operations. In one embodiment, the gas-lift method may include opening a single downhole valve until a pressure setpoint is achieved at that valve and then opening a lower downhole valve while closing the prior valve. In one embodiment, the gas-lift method may include maintaining a desired pressure at the lowest downhole valve with the valve fully open while keeping the rest of the downhole valves substantially closed. In one embodiment, the plurality of valves are selectively opened or closed to maintain a desired pressure distribution within the wellbore. In one embodiment, only one of the valves is opened at a time while the remaining valves stay closed. In other embodiments, one of the valves is closed at or near the same time as another one of the valves is opened.

For a gas-lift operation, one general goal is to create a consistent pressure distribution between the inner portion of the tubing string and the outer portion of the tubing string such that the injected gas assists in an artificial lift of the produced fluid. For the initiation of a gas lift operation, it is desired to feed gas from the surface into the top of the wellbore (whether via the tubing or the annulus of the tubing) and drive that gas at a particular pressure all the way to the bottom of the wellbore.

In conventional gas lift operations, each of the downhole valves has a pressure point or threshold at which it opens. In other words, a particular valve may remain in a closed position until a desired pressure builds up within the valve, at which point a valve member within the valve is hydraulically opened based on the built up pressure to allow fluid flow through the valve. Once that valve pressure goes beneath a specific pressure, that valve closes. Typically a prior art valve is a hard open or hard closed valve. For example, if a pressure of 1000 bar is desired within the wellbore, each of the downhole valves in the prior art may be set to open at 1000 bar. As the pressure is fed into the wellbore, each valve opens at 1000 bar as the gas travels down the wellbore. As the gas at a particular valve (corresponding to a particular level or height within the wellbore) falls beneath 1000 bar, it closes so that pressure may be built up in that region again. For conventional gas lift operations, the hydraulically actuated valves results in an unequal or undesired pressure distribution through the wellbore because the valves are opening or closing at the wrong times. Further, it may take weeks or months for just a few valves to come "on-line" and to have the desired pressure met at particular valve. In some instances, the lower downhole valves (even those wellbores having less than ten valves) never turn on and off, indicating that the desired pressure was never achieved at the particular valve. Further, in slug flow operations, an intermittent fluid flow or pressure spike may occur within a zone of the wellbore, which causes the valves to open or close unexpectedly, which essentially chokes off the injected gas and stops the injection process. Existing valves and valve systems for artificial lift operations presents numerous problems and drawbacks.

In contrast, the disclosed gas-lift process of the present application allows selective actuation of a particular valve, which can be tied to any particular parameter, such as a pressure differential. In other words, the disclosed gas-lift operations herein allow for a precision control of the pressure distribution within the wellbore based on selectively opening and/or closing each of the plurality of valves distributed along the tubing in a wellbore. This allows much better pressure distributions and control within the wellbore, increased monitoring and control of fluid (such as slug flow issues) during gas-lift operations, and a much quicker time to get pressures distributed within the wellbore. In one embodiment, the upper two, three, or four valves may be selectively actuated within a matter of minutes or hours (in contrast to days or weeks for a conventional gas lift operation). In one embodiment, the time between actuating the fourth or fifth valve (and subsequent valves) and the corresponding time to build up the necessary pressure between lower downhole valves may take hours, days, or weeks. In other words, the greater the depth within the wellbore, the longer it takes for the injected gas to be distributed and meet the desired pressure differentials at each of the valves. Nevertheless, the disclosed valves and related gas-lift operations described herein can be operated in a significantly faster method than prior valves and techniques.

Figure 8:
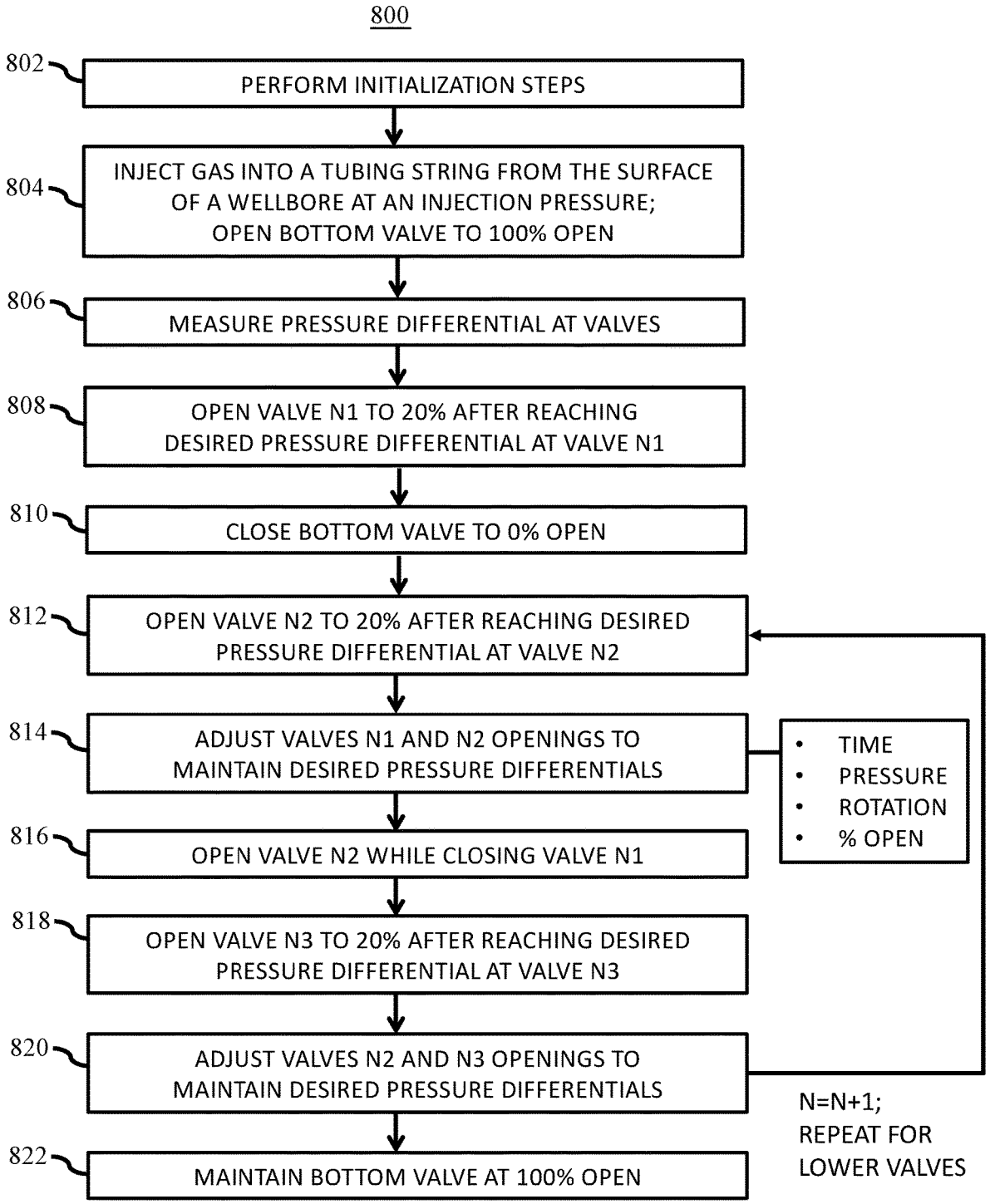
FIG. 8 illustrates one method for gas-lift operations utilizing the disclosed downhole valve according to one embodiment of the present disclosure.

FIG. 8 illustrates one exemplary method 800 for a gas-lift operation according to one embodiment of the pressure disclosure. In one embodiment, each of the downhole valves is similar to the valves disclosed herein, such as a valve substantially similar as FIGS. 1A, 2A, and 3A. In one embodiment, each of the downhole valves is coupled to one or more pressure sensors that measures a pressure within the tubing and a pressure in the annulus of the tubing proximate to the downhole valve to determine a pressure differential at the selected valve. In one embodiment, each of the plurality of valves is coupled together via a physical control wire (such as a TEC cable) to a computer system near the wellbore surface. In some embodiments, the computer system near the wellbore surface performs various controls, logic steps, and processing operations, and transmits those signals to each of the downhole valves as appropriate. In other embodiments, a computer system near the wellbore surface merely transmits signals or commands to each of the downhole valves, and a separate control system (such as at a remote location such as a computer connected to the surface computer system via the Internet) performs the necessary logic or control steps and sends signals to the surface control system to communicate those commands to the downhole valves. In still other embodiments, an operator may manually monitor and control each of the valves at a remote location and transmit such commands to a computer system near the wellbore that transmits such signals to the relevant downhole valves. In still another embodiment, each of the downhole valves has a processor and memory that can perform the necessary logic operations or process control operations to perform the desired steps herein. In one embodiment, a plurality of valves has already been coupled to a tubing string and positioned downhole in a wellbore prior to the steps illustrated in FIG. 8. The steps illustrated in method 800 can be performed regardless of whether the gas is injected through the tubing or through the annulus of the tubing. In contrast, conventional gas lift operations requires a workover of the tubing string and valve assembly to perform reverse gas lift operations. While the embodiment illustrated in method 800 is directed to injecting gas into the tubing string, in one embodiment the same steps with the same valves can be performed with injecting gas into the annulus of the tubing string in a cased hole. In one embodiment, the steps illustrated in method 800 are directed to the initiation of a gas-lift operation in a wellbore (i.e., the initial process of creating a substantially equal pressure distribution through the wellbore prior to any gas lift operations).

Step 802 comprises performing initialization and measurement steps prior to the injection of gas. Such steps may include entering various data for the well and the downhole valves (such as depths of each valve), the setting of various desired pressure differentials at the downhole valves (such as 50 psi, 100 psi, etc.), and the setting of an injection gas point pressure. At this point, software scripts may be turned off (in a manual mode) or on (if in an automated mode). In one embodiment, all of the valves may be tested by opening and/or closing each of the valves to confirm that they are working. Similarly, pressure measurements and other measurements may be taken at each of the valves. In one embodiment, pressures and temperatures are measured in real-time or every one minute (as one example) to perform substantially continuous measurements. In one embodiment, gas injection pressure and volume is measured for minimal operating thresholds. In another embodiment, high-pressure gas lift may be utilized based on the valves and methods disclosed herein. For example, high-pressure gas lift may include simply opening the bottom valve downhole assembly and injecting gas at a very high pressure through the bottom valve.

Step 804 comprises injecting gas into a tubing string from the surface of the wellbore, wherein the tubing string comprises a plurality of downhole valves (valves N1, N2, N3, . . . , BV). In one embodiment, if the desired pressure of the gas lift-operation is 1100 bars, then the gas may be injected at a pressure approximately equal to the 1100 bars. In other embodiments, the pressure may be greater than or less than that pressure, particularly for initiation operations. For example, while a normal injection pressure may be 1100 bars, for initialization purposes and/or getting the first valve opened a lower pressure point (such as 1000 bars or less) may be utilized. In one embodiment, all of the downhole valves are closed prior to the injecting step but for the lowest/bottom valve. In one embodiment, prior to or at the same time as injecting gas, the bottom valve is opened to 100% open, which allows gas to flow into the tubing string.

Step 806 comprises measuring a pressure differential at each of the downhole valves. In one embodiment each of the valves continuously (such as in real-time or 1 or 5 minute intervals) monitors the inside and outside tubing string pressures at the selected valve locations to determine a pressure differential at the selected valve.

Step 808 comprises opening a first downhole valve N1 from the wellbore surface when a desired pressure is achieved at the N1 valve. For example, the first valve N1 is in a closed position initially while the pressure builds up. For example, an outside annulus pressure may initially be 300 psi, while the pipe pressure may be 1100 psi, creating a pressure differential of 800 psi. As the injected gas continuous to flow through the bottom valve and up through the annulus, the annulus pressure will increase and at some point in time will become close to the pipe pressure of 1100 psi. Once the desired pressure differential is met, the first downhole valve N1 from the wellbore surface may be partially or fully opened. In one embodiment, the desired pressure differential may be between 25-100 psi, such as approximately 50 psi. For example, if gas is injected at 1100 psi, the first downhole valve may be opened when a pressure differential reaches 100 psi, such as when the outside tubing pressure is 1000 psi and the inside tubing pressure is 1100 psi. For a first valve, this may only take a few minutes.

This opening step 808 may be performed automatically or manually by a remote electronic signal, whether via a wired connection to the downhole valve or various wireless techniques as is known to one of skill in the art. The valve may be manually opened via a control system near the surface of the wellbore, or via any other remote location of which a signal is transmitted to a surface control system and subsequently to the downhole valves. For automatic operation, logic steps or other control parameters may be automatically performed by the downhole valve itself (without further direction from a remote control system), a surface control system, or other remote control system. In one embodiment, the valve is fully opened when the desired pressure set point is met; in other embodiments, it may only be partially opened (such as 20% or 50%) for a predetermined time until being opened fully. When valve N1 is opened, gas flows from the inside of the tubing to the outside of the tubing through the corresponding downhole valve N1 at the position the valve is coupled to the tubing string. In one embodiment, valve N1 is partially opened to 20% after reaching the desired pressure differential at the N1 valve. While 20% is one embodiment illustrated herein, any other set point openings may be utilized.

Step 810 comprises closing the bottom valve to 0% open (e.g., 100% closed). In one embodiment, the bottom valve is closed at the same time as opening valve N1. In other embodiments, valve N1 is opened to a certain percentage until the bottom valve is partially or fully closed. In one embodiment, the bottom valve is not fully closed until the upper most valve is fully opened. In one embodiment, the bottom valve is fully closed once the first valve N1 is at least partially opened, such as at least 20% or 50% open.

Step 812 comprises partially opening valve N2 (which is a valve that is one lower than valve N1) once a desired pressure differential is achieved at valve N2. The desired pressure differential for valve N2 may be the same as the desired pressure differential for valve N1. In other embodiments, the desired pressure at the second position may be greater or less than the pressure at the first valve position. In one embodiment, valve N2 is fully opened, while in another embodiment it is only partially opened, such as to a 20% opening or a 50% opening. In one embodiment, valve N2 is opened once a certain pressure differential is met at both valves N1 and N2. In one embodiment, valve N2 is opened only after valve N1 is opened to 100%; in other embodiments, valve N2 may be partially opened even if valve N1 is not yet opened to 100%.

Step 814 comprises adjusting the N1 and N2 valves to maintain a desired pressure differential at those valves. In one embodiment, valve N1 may be fully opened to 100% prior to opening valve N2. In other embodiment, valve N1 may be partially opened to 50% prior to opening valve N2. In one embodiment, valve N1 is opened at a greater percentage than valve N2 as valve N2 is being opened. In one embodiment, an opening of each valve may be incrementally performed by a manual or automatic step. An incremental opening step may be based on time or pressure. The opening step itself may be measured by an opening percentage of the valve and/or a number of rotations of a driving element (e.g., drive shaft or valve head) of the valve. For example, the valve may be opened 5% every 5 minutes (or every 10-30 minutes); similarly, the valve may be opened 5% with every 5 psi (or 10-20 psi) change in the pressure differential. Other variations of the relative openings of valves N1 and N2 are possible. In general, the valves are incrementally and partially opened as necessary to maintain a consistent and desired pressure differential (such as 50 psi or 100 psi) at each valve. In still other embodiments, the second valve may be partially or fully opened for a predetermined period of time (such as 5 minutes) before partially or fully closing the prior valve.

Step 816 comprises opening valve N2 while closing valve N1. In one embodiment, valve N1 has been opened for a sufficient length of time to build up pressure at valves N1 and N2. In one embodiment, valve N1 has been opened to 100% prior to opening valve N2 past a minimal threshold. In other embodiments, valve N1 is open at 100% and valve N2 may be opened at 100% prior to closing valve N1. In one embodiment, once valve N2 is opened to a minimal threshold (such as 20% or 50%), valve N1 is partially closed. In one embodiment, valve N2 is fully open at 100% open while valve N1 is fully closed at 0% open.

Step 818 comprises partially opening valve N3 (which is one lower than valve N1) once a desired pressure differential is achieved at valve N3. In one embodiment, this is substantially similar to step 812 (related to partially opening valve N2). The desired pressure differential for valve N3 may or may not be the same as the desired pressure differentials for valves N1 and N2. In one embodiment, valve N3 is fully opened, while in another embodiment it is only partially opened, such as to a 20% opening or a 50% opening. In one embodiment, valve N3 is opened once a certain pressure differential is met at both valves N2 and N3. In one embodiment, valve N3 is opened only after valve N2 is opened to 100%; in other embodiments, valve N3 may be partially opened even if valve N2 is not yet opened to 100%.

Step 820 comprises adjusting the N2 and N3 valves to maintain a desired pressure differential at those valves. In one embodiment, this step is substantially similar to step 814 (which is directed to valves N1 and N2). Valves N2 and N3 may be individually opened and closed similar to the steps detailed in relation to step 814, with the ultimate goal of opening valve N3 to 100% open and closing valve N2 to 0% closed.

As illustrated in FIG. 8, steps 812-820 are repeated for lower valves. This process of selectively opening and closing individual valves down the length of the tubing, based on a measured pressure differential, in a systematic and orderly fashion may be continued until the desired pressure is measured at the bottom of the wellbore and/or at the lowest downhole valve. An upper valve is opened, and once the desired pressure is measured at a lower valve, the lower valve is opened at or near the same time as closing the upper valve, and so on. In other words, once the third valve is fully opened and the second valve is fully closed, the fourth valve may be fully opened and the third valve is fully closed, and then the fifth valve may be fully opened and the fourth valve may be fully closed. Such steps may be performed incrementally as described herein, and prior to fully opening a particular valve it may be partially opened, such as to a 5%, 10%, 20%, 25%, or 50% opening. In one embodiment, these closing and opening steps are performed automatically (whether via logic contained in the individual valves or based on control logic provided by a remote control system) based on predetermined pressure set points. Such a "soft" opening facilitates equal pressure distributions and movement of fluid within the wellbore to prevent slug flows and other problematic fluid flow situations, and generally minimizes voltage fluid movements within the wellbore. In other words, gradually opening and closing the valves at certain times and/or pressure points facilitates smooth fluid flow within the wellbore between the inner and outer portions of the tubing string, and is a significant advantage over the prior art.

Step 822 comprises maintaining the lowest downhole valve of the wellbore (N=BV) in an open position. In one embodiment, once all of the prior downhole valves have been selectively opened and closed, and the desired pressure of the injected gas has been distributing through the inside of the tubing and the outside of the tubing (based on the selectively opened and closed valves), the gas is continually injected into the bottom of the wellbore through the lowest downhole valve. In one embodiment, the bottom valve may be fully opened, while in other embodiments it may only be partially opened.

One of skill in the art will realize that the above steps may be generally reversed if the gas is injected into the annulus rather than into the tubing string. For example, rather than working downward from the top valve to the bottom valve, the valves are selectively opened and closed from the bottom to the top. In one embodiment, bi-directional flow may be controlled by the valves and operations disclosed herein. Bi-directional flow, in general, is gas lifting a wellbore through the annulus to the tubing, and once the wellbore reduces the bottom hole pressure on a long drawn down cycle, the friction overcomes the fluid column to be lifted to the surface. In one embodiment, an operator can flow gas down the annulus and produce through the casing all while the disclosed valves remain downhole; likewise, an operator can flow gas down the casing and producing through the annulus all while the valves remain downhole. Thus, the embodiments described herein eliminate the need for expensive workovers and intervention and loss of production.

Figure 9A:
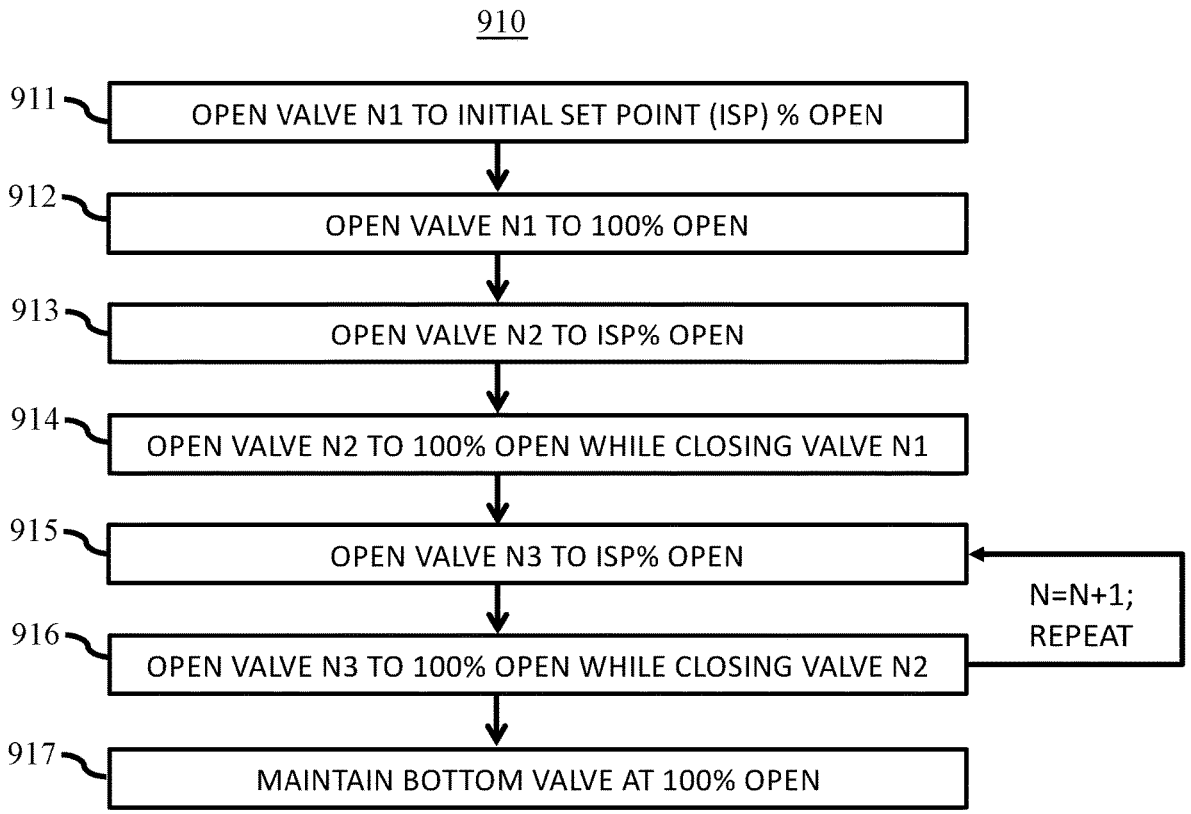
FIGS. 9A-9C illustrates various opening and closing sequences for a gas-lift operation utilizing the disclosed downhole valve according to one embodiment of the present disclosure.
Figure 9B:
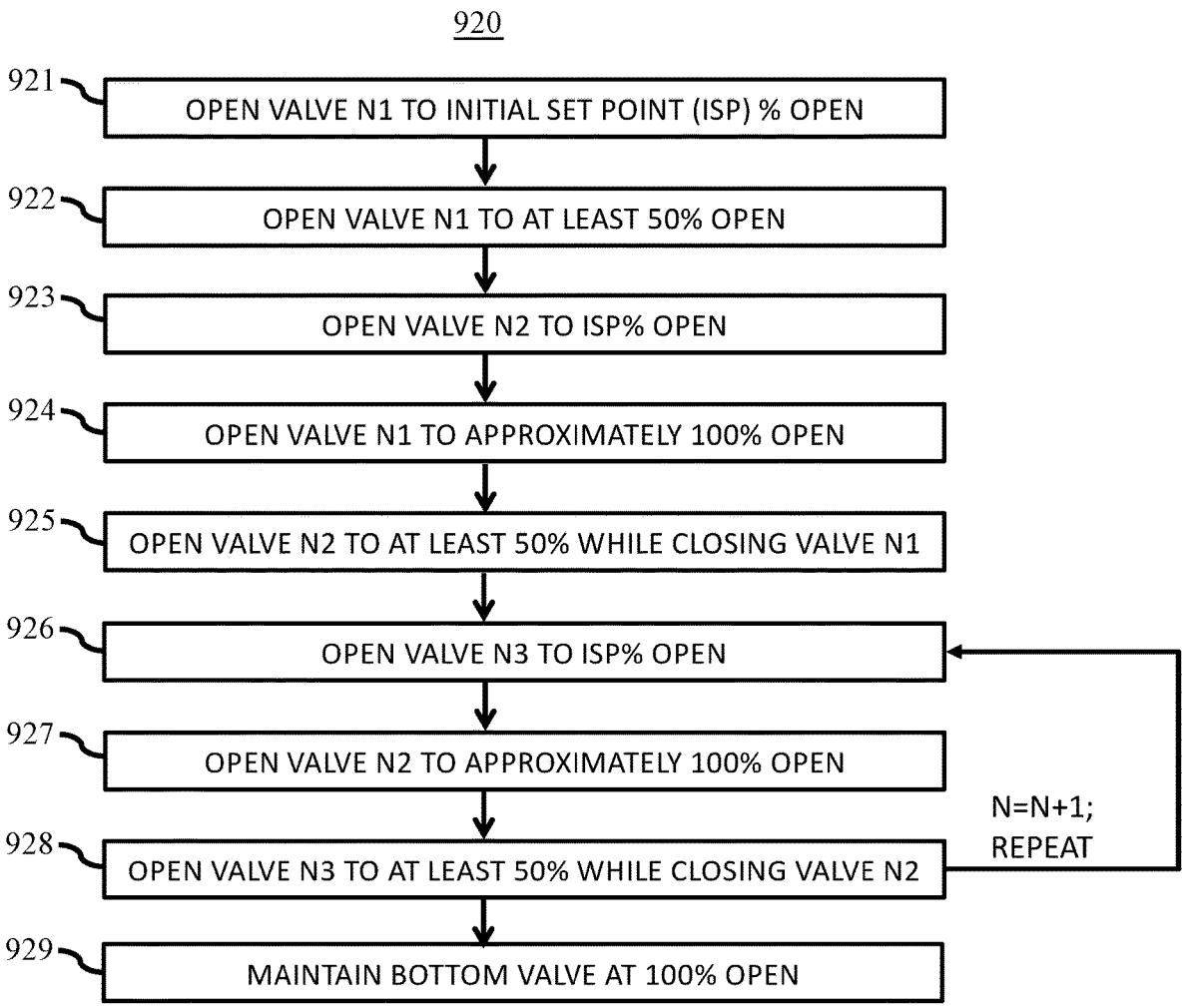
Figure 9C:
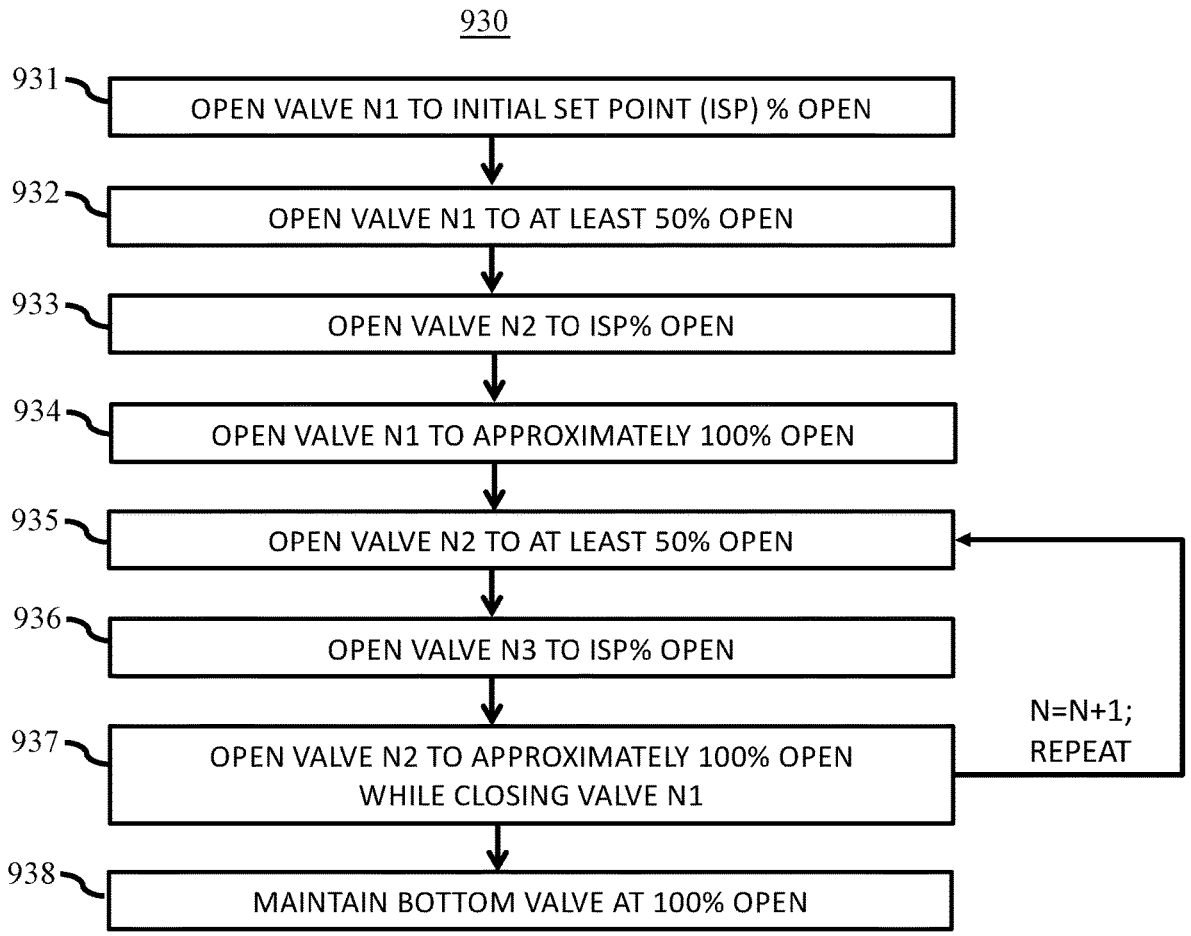

FIGS. 9A-9C illustrates various opening and closing sequences for a gas-lift operation utilizing the disclosed downhole valve according to one embodiment of the present disclosure. In one embodiment, the steps illustrated in FIGS. 9A-9C can be implemented in the general method described in FIG. 8. In one embodiment, steps 812-822 of method 800 can be substituted by the steps illustrated in FIGS. 9A-9C. In one embodiment, the described steps of FIGS. 9A-9C illustrate just a few of the potential embodiments where a first, second, and third relative valve (and more) may be selectively opened and closed in different orders and/or times to achieve the desired result. In other words, the valves are selectively actuated to actively control the fluid flow and pressure distributions within the wellbore with a high level of precision that has been previously untenable. One of skill will recognize that the invention described herein is not limited to such steps, and that there are many other variations of incrementally opening and closing the downhole valves to achieve the same desired results as described herein.

FIG. 9A illustrates method 910, which describes one exemplary sequence for the relative partial opening and closing of a plurality of downhole valves in a gas-lift operation. In general, method 910 comprises fully opening a first valve prior to opening a second lower valve. Step 911 comprises partially opening a first valve (valve N1) to an initial set point (ISP) percentage opening. In one embodiment the ISP is 20%. In other embodiments, the ISP may be between 5-50%, such as 5%, 10%, 20%, 25%, 40%, or 50%. In generally, the goal is to provide an ISP that is "partially" open for the valve to not "shock the system" as much as when valves are fully opened or fully closed in an abrupt manner. In other words, it is a "soft" opening. In one embodiment, as more fully described in FIG. 8, valve N1 may be partially opened once a desired pressure differential is met for the valve (such as 50 or 100 psi). In other embodiments, it may be partially opened after a certain amount of time has passed relative to the opening of a prior valve. Step 912 comprises opening valve N1 to 100% open. In some embodiments, it is opened from the ISP to 100% open in a single step, while in other embodiments it is incrementally opened from the ISP to 100% open based on various parameters, whether time or pressure differential. For example, it may be programmed to open (or manually opened) every 5 minutes by a 5% opening, or it may be programmed to open quicker based on how fast the pressure differential is decreasing. Step 913 comprises opening valve N2 to the ISP % Open. For example, once valve N1 has been opened to 100% open, valve N2 may be opened to 20% open (if 20% is the ISP for valve 2) once a certain pressure differential has been met at valve N2. In other embodiments, after a predetermined period of time of valve N1 being opened at 100%, valve N2 may be partially opened to the ISP. In other embodiments, the ISP is different for the first valve as opposed to the second valve. Step 914 comprises opening valve N2 to 100% while closing valve N1. Such steps may be performed incrementally; for example, valve N2 may be incrementally increased from 20% to 100%, while valve N1 may be incrementally decreased from 100% to 0%. In some embodiments, valve N1 is fully closed (0% open), while in other embodiments it is partially closed (e.g., 25% open). Step 915 comprises opening valve N3 to the ISP opening percentage (similar to steps 911 and 913), while step 916 comprises opening valve N3 to 100% open while closing valve N2 (similar to step 914). Such steps are similarly repeated for all of the lower valves in an orderly and systematic fashion. Step 917 comprises maintaining the bottom valve at 100% open for general gas-lift operations once the previous valves have been opened and closed and the injection gas effectively worked downhole.

FIG. 9B illustrates method 920, which describes one exemplary sequence for the relative partial opening and closing of a plurality of downhole valves in a gas-lift operation. While method 920 is similar to method 910, in general, method 920 comprises partially opening a second valve prior to the first valve being fully opened. Step 921 comprises partially opening a first valve (valve N1) to an initial set point (ISP) percentage opening, such as 20%, when a desired pressure differential is met for the valve (such as 50 or 100 psi). Step 922 comprises opening valve N1 to a second partial opening prior to opening the valve to 100% open. For example, valve N1 may be moved into at least a 50% open position. Such an increased opening step may be performed at once or incrementally. Step 923 comprises opening valve N2 to the ISP opening percentage, such as 20%. In contrast to method 910 in FIG. 9A, valve N2 is partially opened prior to fully opening valve N1. For example, valve N1 may only be 50% open while valve N2 is opened to 20% open. This embodiment is another way to achieve a "slow" and "staggered" opening of the valves, which helps to achieve a more uniform and/or balanced pressure differential. Step 924 may comprise opening valve N1 to approximately 100% open. In other words, valve N1 is opened in step 924 to approximately 100% open only after lower valve N2 is at least partially opened. Step 925 comprises opening valve N2 to at least 50% while closing valve N1. Such steps may be performed incrementally; for example, valve N2 may be incrementally increased from 20% to 50% or more, while valve N1 may be incrementally decreased from 100% to 0%. In some embodiments, valve N1 is fully closed (0% open), while in other embodiments it is partially closed (e.g., 25% open). Step 926 comprises opening valve N3 to the ISP opening percentage (similar to steps 921 and 923), while step 927 comprises opening valve N2 to 100% open (similar to step 924), while step 928 comprises opening valve N3 to at least 50% open while closing valve N2 (similar to step 925). Again, a lower valve is partially opened prior to fully opening a prior valve, and a prior valve may be closed prior to fully opening a subsequent valve. Such steps are similarly repeated for all of the lower valves in an orderly and systematic fashion. Step 929 comprises maintaining the bottom valve at 100% open for general gas-lift operations once the previous valves have been opened and closed and the injection gas effectively worked downhole.

FIG. 9C illustrates method 930, which describes one exemplary sequence for the relative partial opening and closing of a plurality of downhole valves in a gas-lift operation. While method 930 is similar to method 920, in general, method 930 comprises partially opening and closing three valves at a time rather than just two valves. Such a scenario may be useful if the overall method is highly dynamic and/or the pressure distributions are changing rapidly. Step 931 comprises partially opening a first valve (valve N1) to an initial set point (ISP) percentage opening, such as 20%, when a desired pressure differential is met for the valve (such as 50 or 100 psi). Step 932 comprises opening valve N1 to a second partial opening prior to opening the valve to 100% open. For example, valve N1 may be moved into at least a 50% open position. Such an increased opening step may be performed at once or incrementally. Step 933 comprises opening valve N2 to the ISP opening percentage, such as 20%. Thus, similar to method 920 in FIG. 9B, valve N2 is partially opened prior to fully opening valve N1. For example, valve N1 may only be 50% open while valve N2 is opened to 20% open. This embodiment is another way to achieve a "slow" and "staggered" opening of the valves. Step 934 may comprise opening valve N1 to approximately 100% open. In other words, valve N1 is opened in step 934 to approximately 100% open only after lower valve N2 is at least partially opened. Step 935 comprises opening valve N2 to at least 50%, while step 936 comprises partially opening valve N3 to an ISP percentage opening, such as 20%. In contrast to method 920 in FIG. 9B, valves N2 and N3 are opened prior to closing valve N1; in other words, at a given time three valves may be at least partially opened in the embodiment illustrated in FIG. 9C. Step 937 may comprise opening valve N2 to approximately 100% open while closing valve N1. Such steps may be performed incrementally; for example, valve N2 may be incrementally increased to 100%, while valve N1 may be incrementally decreased from 100% to 0%. In some embodiments, valve N1 is fully closed (0% open), while in other embodiments it is partially closed (e.g., 25% open). Such steps are similarly repeated for all of the lower valves in an orderly and systematic fashion. Step 938 comprises maintaining the bottom valve at 100% open for general gas-lift operations once the previous valves have been opened and closed and the injection gas effectively worked downhole.

Consistent with the above methods, Tables I-III are provided below that give another illustration of the selective actuation of a plurality of downhole valves at a plurality of different arbitrary "times" during the initialization of a gas lift operation.

Table I provides an example where two valves are changed at or near the same time and when there is an initial set point of 20%, such that there is effectively a "soft" open and a "soft" close (0%→20% →100% →20% →0%) for each valve. Table I illustrates a wellbore with five downhole valves, numbered n1 at the top to n5 at the bottom, at 15 successive time intervals. Table I illustrates an exemplary opening percentage of each valve during the initialization of a gas lift process, similar to what may be performed by method 800 in FIG. 8.

TABLE I

| Percentage (%) of Valve Open over Various Time (t) Intervals | | | | | | | | | | | |
|---|---|---|---|---|---|---|---|---|---|---|---|
| valve | $t_0$ | $t_1$ | $t_2$ | $t_3$ | $t_4$ | $t_5$ | $t_6$ | $t_7$ | $t_8$ | $t_9$ | $t_{10}$ |
| n1 | 0 | 0 | 20 | 100 | 100 | 20 | 0 | 0 | 0 | 0 | 0 |
| n2 | 0 | 0 | 0 | 0 | 20 | 100 | 100 | 100 | 20 | 0 | 0 |
| n3 | 0 | 0 | 0 | 0 | 0 | 0 | 0 | 20 | 100 | 100 | 100 |
| n4 | 0 | 0 | 0 | 0 | 0 | 0 | 0 | 0 | 0 | 0 | 20 |
| n5 | 0 | 100 | 100 | 0 | 0 | 0 | 0 | 0 | 0 | 0 | 0 |

| | $t_{11}$ | $t_{12}$ | $t_{13}$ | $t_{14}$ | $t_{15}$ |
|---|---|---|---|---|---|
| n1 | 0 | 0 | 0 | 0 | 0 |
| n2 | 0 | 0 | 0 | 0 | 0 |
| n3 | 20 | 0 | 0 | 0 | 0 |
| n4 | 100 | 100 | 100 | 20 | 0 |
| n5 | 0 | 0 | 20 | 100 | 100 |

As illustrated in Table I, at an initial time, all of the valves are closed (e.g., they are 0% open). During or prior to the start of gas injection, the bottom valve n5 is fully opened to 100% open at t1. The other valves remain closed. At t2, the upper valve n1 is partially opened to 20%. At t3, valve n1 is opened to 100%, which may be done in one step or incrementally based on various parameters. At t4, valve n2 is opened to 20% once a predetermined pressure differential is met. At t5, valve n1 is closed to 20% open and valve n2 is opened to 100% open, which may be done gradually/incrementally as described herein. At t6, valve n1 is fully closed while valve n2 is fully open. This process is repeated over and over again until the bottom valve is a 100% open position, as indicated at t15. In other embodiments, the upper valve may be closed at the same time as opening the lower valve.

Table II provides an example where two valves are changed at or near the same time and when there is an initial set point of 20%, such that there is effectively a "soft" open and a "soft" close (0%→20% →100% →20% →0%) for each valve similar to Table I. However, in Table II at least for a portion of the time both valves are in a 100% open mode. Table II illustrates a wellbore with five downhole valves, numbered n1 at the top to n5 at the bottom, at 20 successive time intervals. Table II illustrates an exemplary opening percentage of each valve during the initialization of a gas lift process, similar to what may be performed by method 800 in FIG. 8.

TABLE II

| Percentage (%) of Valve Open over Various Time (t) Intervals | | | | | | | | | | | |
|---|---|---|---|---|---|---|---|---|---|---|---|
| valve | $t_0$ | $t_1$ | $t_2$ | $t_3$ | $t_4$ | $t_5$ | $t_6$ | $t_7$ | $t_8$ | $t_9$ | $t_{10}$ |
| n1 | 0 | 0 | 20 | 100 | 100 | 100 | 20 | 0 | 0 | 0 | 0 |
| n2 | 0 | 0 | 0 | 0 | 20 | 100 | 100 | 100 | 100 | 100 | 20 |
| n3 | 0 | 0 | 0 | 0 | 0 | 0 | 0 | 0 | 20 | 100 | 100 |
| n4 | 0 | 0 | 0 | 0 | 0 | 0 | 0 | 0 | 0 | 0 | 0 |
| n5 | 0 | 100 | 0 | 0 | 0 | 0 | 0 | 0 | 0 | 0 | 0 |

| | $t_{11}$ | $t_{12}$ | $t_{13}$ | $t_{14}$ | $t_{15}$ | $t_{16}$ | $t_{17}$ | $t_{18}$ | $t_{19}$ | $t_{20}$ |
|---|---|---|---|---|---|---|---|---|---|---|
| n1 | 0 | 0 | 0 | 0 | 0 | 0 | 0 | 0 | 0 | 0 |
| n2 | 0 | 0 | 0 | 0 | 0 | 0 | 0 | 0 | 0 | 0 |
| n3 | 100 | 100 | 100 | 20 | 0 | 0 | 0 | 0 | 0 | 0 |
| n4 | 0 | 20 | 100 | 100 | 100 | 100 | 100 | 20 | 0 | 0 |
| n5 | 0 | 0 | 0 | 0 | 0 | 20 | 100 | 100 | 100 | 100 |

As illustrated in Table II, at an initial time, all of the valves are closed (e.g., they are 0% open). During or prior to the start of gas injection, the bottom valve n5 is fully opened to 100% open at t1. The other valves remain closed. At t2, the upper valve n1 is partially opened to 20%. At t3, valve n1 is opened to 100%, which may be done in one step or incrementally based on various parameters. At t4, valve n2 is opened to 20% once a predetermined pressure differential is met. At t5, valve n2 is fully open to 100%, which may be done gradually/incrementally as described herein. Thus, at t5, both valves n1 and n2 are fully open. At t6, valve n1 is closed to 20%. At t7, valve n1 is closed to 0%, leaving valve n2 in a fully open position. This process is repeated over and over again until the bottom valve is a 100% open position, as indicated at t20.

Table III provides an example where three valves are changed at or near the same time and when there is an initial set point of 20% and an intermediary point of 50%, such that there is effectively a "soft" open and a "soft" close (0%→20%→50%→100%→50%→20%→0%) for each valve. Table III illustrates a wellbore with five downhole valves, numbered n1 at the top to n5 at the bottom, at 17 successive time intervals. Table III illustrates an exemplary opening percentage of each valve during the initialization of a gas lift process, similar to what may be performed by method 800 in FIG. 8.

TABLE III

| Percentage (%) of Valve Open over Various Time (t) Intervals | | | | | | | | | | | |
|---|---|---|---|---|---|---|---|---|---|---|---|
| valve | $t_0$ | $t_1$ | $t_2$ | $t_3$ | $t_4$ | $t_5$ | $t_6$ | $t_7$ | $t_8$ | $t_9$ | $t_{10}$ |
| n1 | 0 | 0 | 20 | 50 | 50 | 100 | 100 | 50 | 20 | 0 | 0 |
| n2 | 0 | 0 | 0 | 0 | 20 | 20 | 50 | 100 | 100 | 100 | 50 |
| n3 | 0 | 0 | 0 | 0 | 0 | 0 | 0 | 0 | 20 | 50 | 100 |
| n4 | 0 | 0 | 0 | 0 | 0 | 0 | 0 | 0 | 0 | 0 | 0 |
| n5 | 0 | 100 | 100 | 0 | 0 | 0 | 0 | 0 | 0 | 0 | 0 |

| | $t_{11}$ | $t_{12}$ | $t_{13}$ | $t_{14}$ | $t_{15}$ | $t_{16}$ | $t_{17}$ |
|---|---|---|---|---|---|---|---|
| n1 | 0 | 0 | 0 | 0 | 0 | 0 | 0 |
| n2 | 20 | 0 | 0 | 0 | 0 | 0 | 0 |
| n3 | 100 | 100 | 50 | 20 | 0 | 0 | 0 |
| n4 | 20 | 50 | 100 | 100 | 100 | 50 | 0 |
| n5 | 0 | 0 | 0 | 20 | 50 | 100 | 100 |

As illustrated in Table III, at an initial time, all of the valves are closed (e.g., they are 0% open). During or prior to the start of gas injection, the bottom valve n5 is fully opened to 100% open at t1. The other valves remain closed. At t2, the upper valve n1 is partially opened to 20%. At t3, valve n1 is opened to 50%, which may be done in one step or incrementally based on various parameters. At t4, valve n2 is opened to 20% once a predetermined pressure differential is met. At t5, valve n1 is opened to 100%, which may be done in one step or incrementally based on various parameters. At t6, valve n2 is opened to 50%, which may be done in one step or incrementally based on various parameters. At t7, valve n1 is decreased to 50% while valve n2 is increased to 100%; such steps may be performed at or near the same time or one valve is closed while another is opened or based on some incremental changes based on predetermined conditions. At t8, valve n3 is opened to 20% once a predetermined pressure differential is met. Thus, at t8, valve n1 is open at 20%, valve n2 is open at 100%, and valve n3 is open at 20%. At t9, valve n1 is closed to 0% and valve n3 is open to 50%. This process is repeated over and over again until the bottom valve is a 100% open position, as indicated at t17.

Slug Flow

In some embodiments, two-phase flow may occur within the wellbore, which may include bubbly flow, slug flow, churn flow, and annular flow, as is known in the art, which may be generally considered as intermittent fluid issues. Two phase flow is the interacting flow of two phases, liquid, solid, or gas, where the interface between the phases is influenced by their motion. Slug flow may occur when large slugs of liquid alternate with large gas pockets. A slug flow causes a well shutdown by effectively choking off fluid flow. Slug flows and other similar fluid issues destroys pipes and valves. In short, slug flows are a huge problem and the prevention of slug flows and the control of slug flows is desirable. However, existing gas-lift techniques are not particularly effective towards slug flow conditions because they are not able to properly identify the slug flows as they are occurring and control the slug flow once identified. In one embodiment, slug flow may occur during a gas-lift operation, and the present disclosure provides an effective method for slug flow control.

Figure 10:
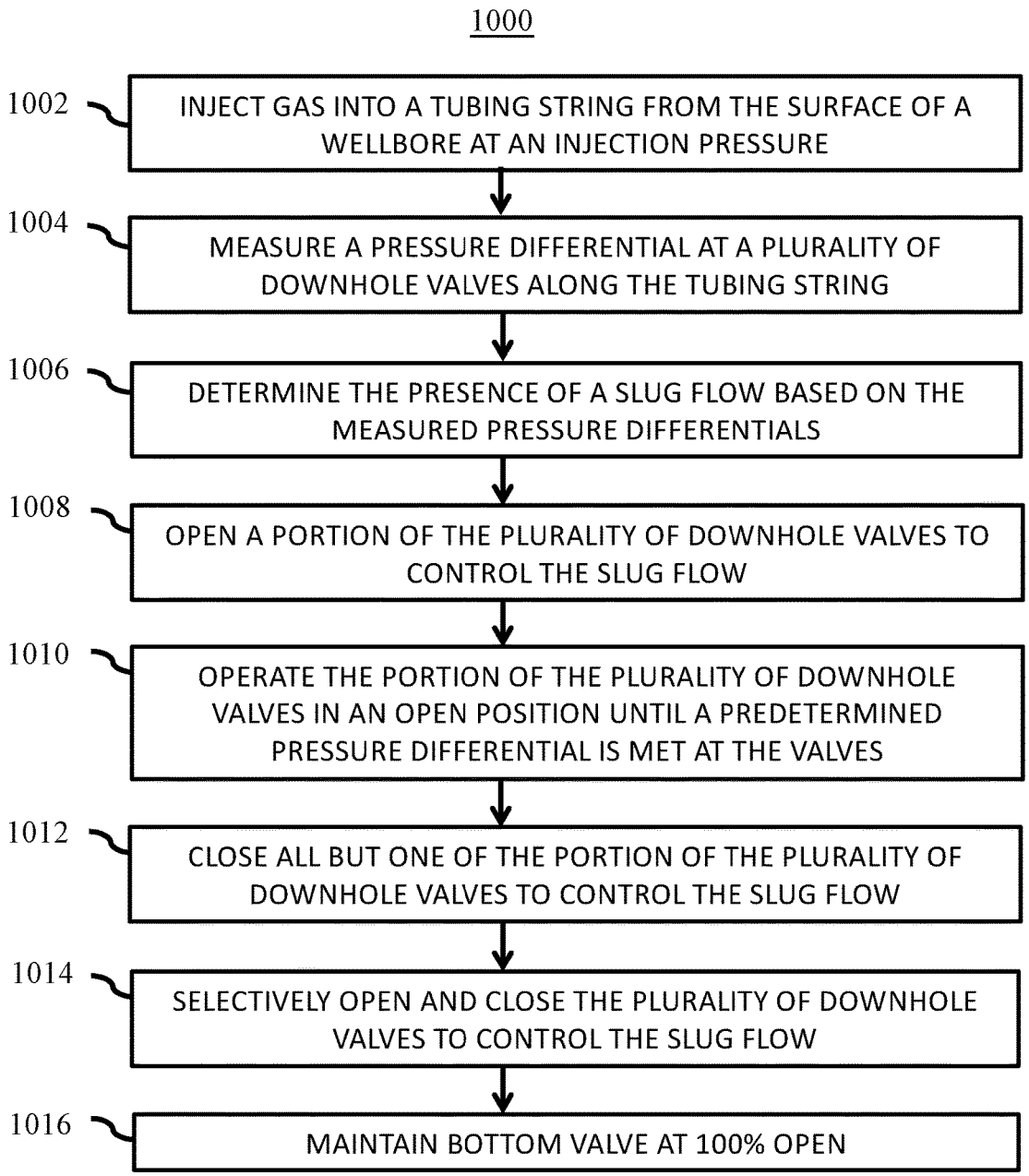
FIG. 10 illustrates one method for controlling a slug flow in a gas-lift operation utilizing the disclosed downhole valve according to one embodiment of the present disclosure.

FIG. 10 illustrates one method for controlling a slug flow in a gas-lift operation utilizing the disclosed downhole valve according to one embodiment of the present disclosure. Step 1002 of method 1000 comprises injecting gas into a wellbore at an injection pressure. The gas may be injected into the tubing string or into the annulus of the tubing string. Along the tubing string is positioned a plurality of downhole valves as described herein. In one embodiment, the gas is injected into the tubing string consistent with the methods described herein (such as method 800 in FIG. 8), and the well is being operated in a normal manner while maintaining the bottom valve in a substantially open position. During normal operations of the gas lift operation, in some instances a slug flow problem may occur at some position within the wellbore.

Step 1004 comprises measuring a pressure differential at a plurality of downhole valves along the tubing string. In one embodiment, one or more pressure sensors are coupled to each of the plurality of downhole valves to measure both an inside pressure within the tubing string and an outside pressure (e.g., an annular pressure) outside of the tubing string proximate to the valve, the difference which is described herein as a pressure differential. In one embodiment each of the valves continuously (such as in real-time or 1 or 5 minute intervals) monitors the inside and outside tubing string pressures at the selected valve locations to determine a pressure differential at the selected valve. This may be performed in real-time for the entire length of the wellbore, and the results may be continually monitored, analyzed, and viewed. In some embodiments, the presence of a fluid flow irregularity may be determined, such as a slug flow.

Step 1006 comprises determining the presence of a slug flow within the wellbore based on the measured pressure differentials. Such a determination may be an automatic measurement or a manual determination. The presence of a slug flow may be determined by an irregular pressure differential. For example, during normal gas lift operations after the initialization step, a pressure differential might be 50 to 100 psi to 200 psi, and may be within 10% or so of the injection pressure and considered normal operation and/or a substantially equal pressure distribution within the wellbore. However, when a slug flow is present, there is a sharp pressure differential increase, such that a pressure differential might increase from approximately 50 to 200 psi to between 400-800 psi or more. In some embodiments the pressure increase may be exponential. Such a rapid increase in the pressure differential is indicative of a problematic fluid flow condition, such as a slug flow. Such a high pressure differential might be found not only in a single valve, but at a portion of the plurality of downhole valves. In some instances, continuous measuring of the plurality of downhole valves will show an increased pressure differential in two or three or four of the valves somewhere along the wellbore. For example, for simplicity, three valves x, y, and z may be located in a middle portion of a wellbore, with valve x being the upper valve, valve y being a lower valve, and valve z being the lowest valve. Based on a measurement of the differential pressures within the wellbore, one can determine that the slug flow is between the valves x and z. For example, the inner tubing pressure may be relatively constant (e.g., 1500 psi), and the outer tubing pressure may be 1800 psi, 2000 psi, and 2200 psi at valve positions x, y, and z, respectively. Such pressures may indicate that presence of a slug flow or irregular condition at valve positions x, y, and z.

Step 1008 comprising opening a portion of the plurality of downhole valves to control the slug flow. In one embodiment, the downhole valves which indicate a high pressure differential are fully opened, along with the bottom valve. In another embodiment, all of the downhole valves starting at the highest valve indicating a slug flow and lower to the bottom valve are fully opened. In another embodiment, only the downhole valves where the slug flow is present are partially open while maintaining the bottom valve in a fully opened position. This opening step is intended to capture the slug flow at that particular level within the wellbore before it travels up the entire fluid column within the wellbore. Such a step may be performed automatically once a predetermined pressure threshold is reached (such as pressure differentials greater than 200 psi, 400 psi, or 25% of the injection pressure). For the above illustration, valves x, y, and z (which indicate the presence of a slug flow) may be fully opened and the bottom valve may likewise be kept open.

Step 1010 comprises operating the plurality of downhole valves that were opened in step 1008. Such a step is intended to control the slug flow at the particular location within the wellbore and regulate the pressure differentials caused by the slug flow proximate to those opened valves. After a certain period of time, the slug flow may slowly go away, which is indicated by a reduced pressure differential at one of more of the opened valves.

Step 1012 comprises closing all of the plurality of downhole valves but for one of the plurality of valves to control the slug flow and to re-establish an equal pressure distribution within the wellbore. This may be determined by measuring the pressure differential at all of the opened valves. In one embodiment, the upper most opened valve is kept open once the pressure differential at that valve is sufficiently low. In other embodiments, a desired pressure differential must be present at each of the opened valves prior to closing those valves and/or keeping the upper valve open. In one embodiment, an upper valve is kept open while the lower valves are closed. In other embodiments, each of the opened valves is selectively closed once it reaches the desired pressure differential.

Step 1014 comprises selectively opening and closing certain valves to control the slug flow and/or to re-establish a substantially even pressure distribution within the wellbore. Step 1014 may be considered as an alternative to step 1012. In other words, the slug flow has caused uneven pressure distributions within the wellbore in contrast to normal gas-lift situations, and the well needs to be re-initialized from top to bottom by the selective opening and closing of the valves consistent with the method 800 taught in FIG. 8. Such a procedure (similar to that described in FIG. 8) may be repeated as the slug flow is worked down the wellbore by selectively opening and closing individual valves based on the measured pressures and/or otherwise catch the pressure response based on opening and closing particular valves. Step 1016 comprises maintaining the bottom valve at 100% open once the upper valves have been selectively opened and closed. Such a selective and individualized control of the downhole valves for a gas-lift operation are not possible based on conventional downhole valve systems and operations.

Figure 11:
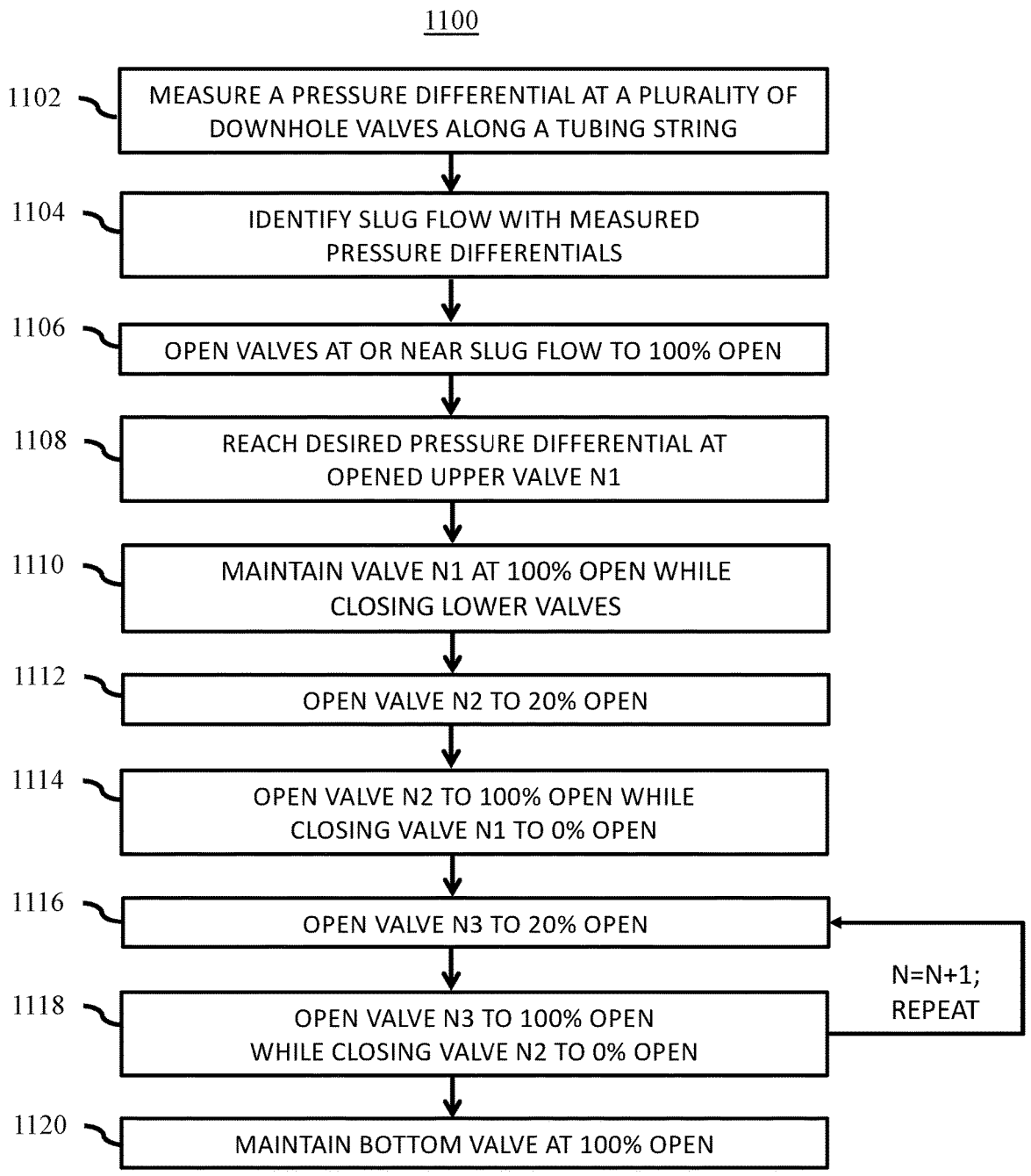
FIG. 11 illustrates one method for controlling a slug flow in a gas-lift operation utilizing the disclosed downhole valve according to one embodiment of the present disclosure.

FIG. 11 illustrates one method for controlling a slug flow in a gas-lift operation utilizing the disclosed downhole valve according to one embodiment of the present disclosure. In one embodiment, the method 1100 described in FIG. 11 is similar to method 1000 described in FIG. 10, but illustrates a more detailed illustration of the selective opening and closing of the plurality of downhole valves to capture and/or eliminate the slug flow.

Step 1102 comprises measuring a pressure differential at a plurality of downhole valves along a tubing string, similar to step 1004 in FIG. 10. Step 1104 comprises identifying a slug flow within the wellbore based on the measured pressure differentials, which is similar to step 1006 in FIG. 10. Step 1106 comprises opening the downhole valves at or near the slug flow to 100% open. For example, if a wellbore contains 10 valves, and based on higher pressure differentials a slug flow is indicated at valves 7-9, valves 7-9 are opened to 100% open. The bottom valve may remain in an open position. Step 1108 comprises reaching a desired pressure differential at the opened valves where the slug flow was previously present, such as at the uppermost valve. In the prior example, this would be valve 7. In one embodiment, only the pressure differential at valve 7 is important, while in other embodiments the pressure differential at valves 7-9 would be relevant. Step 1110 comprises maintaining the upper valve (N1) of the slug flow area in an open position while closing the lower valves to a closed position, which may be similar to step 1012 in FIG. 10. In the prior example, valve 7 would be opened while valves 8-10 (10 being the bottom valve) would be fully closed. The remaining steps described below are similar to step 1014, in which the valves are selectively opened and closed to control the slug flow within the wellbore.

Step 1112 comprises opening valve N2 (valve 8) to 20% open. In one embodiment this is performed once the desired pressure differential is achieved at valve N2. Step 1114 comprises opening valve N2 to 100% open while closing valve N1 (valve 7). In one embodiment this is performed once the desired pressure differential is achieved at valve N2. In one embodiment, valve N1 (valve 7) is fully closed, while in other embodiments it may be only partially closed. Step 1116 comprises opening valve N3 (valve 9) to 20% open once the desired pressure differential is met at valve N3. Step 1118 comprises opening valve N3 (valve 9) to 100% open while closing valve N2 (valve 8) to 0% open. Such steps 1116 and 1118 are similarly repeated for all of the lower valves in an orderly and systematic fashion. Step 1120 comprises maintaining the bottom valve at 100% open for general gas-lift operations once the previous valves have been opened and closed and the injection gas effectively worked downhole. Of course, one of skill in the art will realize that a wide amount of variations in the incremental openings and closing of the valves may be performed consistent with this disclosure.

Consistent with the above methods, Table IV is provided below that gives an illustration of the selective actuation of a plurality of downhole valves at a plurality of different arbitrary "times" during the control of a slug flow. Table IV provides an example where two valves are changed at or near the same time and when there is an initial set point of 20%, such that there is effectively a "soft" open and a "soft" close (0%→20%→100%→20%→0%) for each valve. Table IV illustrates a wellbore with five downhole valves, numbered n1 at the top to n5 at the bottom, at 15 successive time intervals. Table IV illustrates an exemplary opening percentage of each valve during the control of a slug flow during a gas lift process, similar to what may be performed by method 1100 in FIG. 11.

TABLE IV

Percentage (%) of Valve Open over Various Time (t) Intervals

| valve | $t_0$ | $t_1$ | $t_2$ | $t_3$ | $t_4$ | $t_5$ | $t_6$ | $t_7$ | $t_8$ | $t_9$ | $t_{10}$ |
|---|---|---|---|---|---|---|---|---|---|---|---|
| n1 | 0 | 0 | 0 | 0 | 0 | 0 | 0 | 0 | 0 | 0 | 0 |
| n2 | 0 | 100 | 100 | 100 | 100 | 100 | 20 | 0 | 0 | 0 | 0 |
| n3 | 0 | 100 | 100 | 0 | 20 | 100 | 100 | 100 | 100 | 100 | 20 |
| n4 | 0 | 100 | 100 | 0 | 0 | 0 | 0 | 0 | 20 | 100 | 100 |
| n5 | 100 | 100 | 100 | 0 | 0 | 0 | 0 | 0 | 0 | 0 | 0 |

| | $t_{11}$ | $t_{12}$ | $t_{13}$ | $t_{14}$ | $t_{15}$ |
|---|---|---|---|---|---|
| n1 | 0 | 0 | 0 | 0 | 0 |
| n2 | 0 | 0 | 0 | 0 | 0 |
| n3 | 0 | 0 | 0 | 0 | 0 |
| n4 | 100 | 100 | 100 | 20 | 0 |
| n5 | 0 | 20 | 100 | 100 | 100 |

As illustrated in Table IV, at an initial time, all of the valves are closed (e.g., they are 0% open) but for the bottom valve (which is 100% open). This is a standard gas lift operation, such as after the result of the steps described in FIG. 8. During the gas lift process, a slug flow may be determined to be present at or near valves n2-n4 by a heightened pressure differential (see FIG. 11). Thus, those valves are opened to 100%. At t1, valves n2, n3, and n4 are opened to 100% to control the slug flow, and the bottom valve remains opened. At t2 (some point later) no change has occurred in the valves and, there may or may not be decreases in the pressure differentials for valves n2-n4. At t3, a desired pressure differential has been achieved at valve n2, and thus all of the valves but for valve n2 are fully closed. Thus, at t3, only valve n2 remains 100% open. The remaining steps are consistent with this disclosure in that the valves are selectively opened and closed from a top to bottom fashion (by any number of incremental variations) to obtain a substantially equal pressure distribution within the wellbore and to control the slug flow. For example, at t4, valve n3 is opened to 20% once a predetermined pressure differential is met. At t5, valve n3 is opened to 100%, which may be performed gradually. At t6, valve n2 is closed to 20% open, which may be performed gradually. At t7, valve n2 is closed to 0% open, which may be performed gradually. At t8, valve n4 is opened to 20% once a predetermined pressure differential is met. This process is repeated over and over again until the bottom valve is a 100% open position, as indicated at t15. Of course, other variations in the incremental opening and closing of the selected valves is within the scope of the present disclosure.

Automation

The described steps may be performed manually or automatically. In one embodiment, any one or more of the methods illustrated in FIGS. 6-11 may be performed manually or automatically. For example, a user may monitor each valve and manually control an opening of the valve (via any computing device connected to a control system for the plurality of valves) by a remote electronic signal. For example, an operator may instruct a particular valve to open or close to a certain amount (whether percentage opened or valve head rotations) as desired. In other embodiments, a control system may be utilized at a remote site, at a surface/wellhead, or within the valve itself to automatically monitor and control each of the plurality of downhole valves. In such an embodiment software, programs, and/or codes may be utilized with machine-readable logic to conduct certain steps in particular orders and/or to open or close a valve when a certain condition has been met, consistent with the above description, described methods, and illustrated flowcharts. One of skill in the art could readily implement the above described steps using the necessary software code and processors.

The described control system and related process and logic steps can be implemented in any of numerous ways. For example, the embodiments may be implemented using hardware, software or a combination thereof. When implemented in software, the software code can be executed on any suitable processor or collection of processors, whether provided in a single computer or distributed among multiple computers. Such computers may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

A computer employed to implement at least a portion of the functionality described herein may comprise a memory, one or more processing units (also referred to herein simply as "processors"), one or more communication interfaces, one or more display units, and one or more user input devices. The memory may comprise any computer-readable media, and may store computer instructions (also referred to herein as "processor-executable instructions") for implementing the various functionalities described herein. The processing unit(s) may be used to execute the instructions. The communication interface(s) may be coupled to a wired or wireless network, bus, or other communication means and may therefore allow the computer to transmit communications to and/or receive communications from other devices.

The various methods or processes outlined herein may be coded as software that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine. In this respect, various inventive concepts may be embodied as a computer readable storage medium or multiple computer readable storage media (e.g., a computer memory, one or more floppy discs, compact discs, optical discs, magnetic tapes, flash memories, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the invention discussed above. The computer readable medium or media can be transportable, such that the program or programs stored thereon can be loaded onto one or more different computers or other processors to implement various aspects of the present invention as discussed above.

The terms "program" or "software" are used herein in a generic sense to refer to any type of computer code or set of computer-executable instructions that can be employed to program a computer or other processor to implement various aspects of embodiments as discussed above. Additionally, it should be appreciated that according to one aspect, one or more computer programs that when executed perform methods of the present invention need not reside on a single computer or processor, but may be distributed in a modular fashion amongst a number of different computers or processors to implement various aspects of the present invention. Computer-executable instructions may be in many forms, such as program modules, executed by one or more computers or other devices. Generally, program modules include routines, programs, objects, components, data structures, etc. that perform particular tasks or implement particular abstract data types. Typically, the functionality of the program modules may be combined or distributed as desired in various embodiments. Also, data structures may be stored in computer readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All of the methods disclosed and claimed herein can be made and executed without undue experimentation in light of the present disclosure. While the apparatus and methods of this invention have been described in terms of preferred embodiments, it will be apparent to those of skill in the art that variations may be applied to the methods and in the steps or in the sequence of steps of the method described herein without departing from the concept, spirit and scope of the invention. In addition, modifications may be made to the disclosed apparatus and components may be eliminated or substituted for the components described herein where the same or similar results would be achieved. All such similar substitutes and modifications apparent to those skilled in the art are deemed to be within the spirit, scope, and concept of the invention.

Many other variations in the system are within the scope of the invention. For example, the disclosed valve assembly may be coupled to a tubing sub in any number of configurations. As another example, the disclosed valve assembly maybe coupled to other downhole tools or equipment, such as production liners, slotted liners, and coiled tubing. Still further, the disclosed valve assembly does not depend on any particular arrangement of a valve plug, dart, sensor, motor, drive train, and/or configuration of inlet and outlet openings of the valve. Likewise, any variety of dart and/or valve plug configurations and valve seat designs may be utilized within the scope of the present disclosure. The valve may be controlled my electronic signals, whether wirelessly or through a wire. Fluids may be injected via the tubing string or through an annulus of the tubing string. Fluid operations may include any fluid injection or production operation, such as artificial gas lift, enhanced oil recovery, and carbon dioxide sequestration. One, two, three, or more valves may be selectively actuated at a given time and at any number of opened positions to control the fluid flow at a given valve location. It is emphasized that the foregoing embodiments are only examples of the very many different structural and material configurations that are possible within the scope of the present invention.

Although the invention(s) is/are described herein with reference to specific embodiments, various modifications and changes can be made without departing from the scope of the present invention(s), as presently set forth in the claims below. Accordingly, the specification and figures are to be regarded in an illustrative rather than a restrictive sense, and all such modifications are intended to be included within the scope of the present invention(s). Any benefits, advantages, or solutions to problems that are described herein with regard to specific embodiments are not intended to be construed as a critical, required, or essential feature or element of any or all the claims.

Unless stated otherwise, terms such as "first" and "second" are used to arbitrarily distinguish between the elements such terms describe. Thus, these terms are not necessarily intended to indicate temporal or other prioritization of such elements. The terms "coupled" or "operably coupled" are defined as connected, although not necessarily directly, and not necessarily mechanically. The terms "a" and "an" are defined as one or more unless stated otherwise. The terms "comprise" (and any form of comprise, such as "comprises" and "comprising"), "have" (and any form of have, such as "has" and "having"), "include" (and any form of include, such as "includes" and "including") and "contain" (and any form of contain, such as "contains" and "containing") are open-ended linking verbs. As a result, a system, device, or apparatus that "comprises," "has," "includes" or "contains" one or more elements possesses those one or more elements but is not limited to possessing only those one or more elements. Similarly, a method or process that "comprises," "has," "includes" or "contains" one or more operations possesses those one or more operations but is not limited to possessing only those one or more operations.

What is claimed is:

1. A method of operating a plurality of downhole valves in a wellbore, comprising:

measuring a pressure differential at each of a plurality of downhole valves coupled to a tubing string in the wellbore;

determining the presence of intermittent fluid flow within the wellbore based on an increased pressure differential of the measured pressure differential;

selectively actuating each of the plurality of downhole valves based on the measured pressure differential; and controlling the intermittent fluid flow within the wellbore based on the selective actuation step.

2. The method of claim 1, further comprising injecting fluid into the tubing.

3. The method of claim 1, wherein the measured pressure differential is calculated as the difference between a first pressure at an inside portion of the tubing string and a second pressure at an outside portion of the tubing string.

4. The method of claim 1, further comprising maintaining a desired pressure differential at each of the plurality of downhole valves based on the actuating step.

5. The method of claim 1, further comprising maintaining a substantially equal pressure distribution within the wellbore based on the actuating step.

6. The method of claim 1, wherein the actuating step comprises selectively actuating each of the plurality of downhole valves between a closed position and an open position.

7. The method of claim 1, wherein the actuating step comprises performing incremental changes to a valve opening on each of the plurality of downhole valves.

8. The method of claim 1, wherein the actuating step comprises partially opening and partially closing each of the plurality of downhole valves.

9. The method of claim 1, wherein the actuating step comprises partially opening each of the plurality of downhole valves to a desired opening percentage.

10. The method of claim 1, wherein the actuating step comprises opening a lower valve of the plurality of downhole valves while closing the immediately preceding valve.

11. The method of claim 1, wherein the actuating step comprises opening each of the plurality of downhole valves to a partial opening prior to fully opening the valve.

12. The method of claim 11, wherein the partial opening of the valve is less than approximately 50% opening.

13. The method of claim 11, wherein the partial opening of the valve is less than approximately 25% opening.

14. The method of claim 1, wherein the actuating step is performed automatically.

15. The method of claim 1, wherein the actuating step is performed manually.

16. The method of claim 1, wherein the actuating step is performed without a remote control signal to the plurality of downhole valves.

17. The method of claim 1, wherein the actuating step is performed with a control signal provided to each of the plurality of downhole valves from a remote location.

18. The method of claim 1, further comprising electronically actuating the plurality of downhole valves into an open position or closed position based on the measured pressure differentials.

19. The method of claim 1, further comprising selectively actuating each of the plurality of downhole valves to meet a desired pressure differential at each of the plurality of downhole valves.

20. The method of claim 1, further comprising actuating at least some of the plurality of downhole valves based on time delay in response to the measured pressure differential.

21. The method of claim 1, further comprising opening at least some of the plurality of downhole valves a predetermined amount for a predetermined period of time based on the measured pressure differential.

22. The method of claim 1, wherein the actuating step comprises opening at least some of the plurality of downhole valves a predetermined amount based on a predetermined pressure differential change.

23. The method of claim 1, wherein the actuation step comprises selectively opening a portion of the plurality of downhole valves to control a slug flow within the wellbore.

24. The method of claim 1, wherein the intermittent fluid flow is a slug flow.

25. The method of claim 24, further comprising identifying a group of the plurality of downhole valves near the slug flow; and selectively opening the group of the plurality of downhole valves.

26. The method of claim 25, further comprising maintaining the group of the plurality of downhole valves in an open position; and closing at least some of the group of the plurality of downhole valves once a predetermined pressure differential is met at the group.

27. The method of claim 26, further comprising closing all but one of the plurality of downhole valves to control the slug flow.

28. A method of operating a gas-lift oil well, comprising:

injecting gas into a tubing string within a wellbore, wherein the tubing string comprises a plurality of downhole valves;

measuring a pressure differential at each of the plurality of downhole valves;

determining the presence of intermittent fluid flow within the wellbore based on an increased pressure differential of the measured pressure differential;

selectively actuating each of the plurality downhole valves based on the measured pressure differential; and controlling the intermittent fluid flow within the wellbore based on the selective actuation step.

29. The method of claim 28, further comprising adjusting a valve opening of each of the plurality of downhole valves to maintain a desired pressure differential at each of the plurality of valves.

30. The method of claim 28, further comprising maintaining only one of the plurality of downhole valves in a substantially open position.

31. The method of claim 28, further comprising maintaining only two of the plurality of downhole valves in a substantially open position.

32. The method of claim 28, further comprising adjusting an opening of at least two of the plurality of downhole valves at the same time.

33. The method of claim 28, further comprising maintaining a bottom valve of the plurality of downhole valves in a substantially open position while injecting gas into the tubing string.

34. The method of claim 28, wherein the plurality of downhole valves comprises at least a first valve and a second valve vertically lower than the first valve within the wellbore, further comprising partially opening the first valve; and fully opening the first valve after partially opening the first valve.

35. The method of claim 34, further comprising opening the first valve at a first pressure differential at the first valve; and opening the second valve at a second pressure differential at the second valve.

36. The method of claim 35, wherein the first pressure differential is approximately the same as the second pressure differential.

37. The method of claim 34, further comprising partially opening the second valve after the first valve has been fully opened.

38. The method of claim 34, further comprising at least partially closing the first valve after the second valve has been fully opened.

39. The method of claim 34, further comprising opening the second valve while closing the first valve.

40. The method of claim 34, further comprising closing the first valve after partially opening the second valve.

41. The method of claim 34, further comprising substantially opening the second valve after substantially closing the first valve.

42. A method of operating a gas-lift oil well, comprising:

injecting gas into a tubing string within a wellbore, wherein the tubing string comprises a plurality of downhole valves coupled to the tubing string;

measuring a fluid parameter at each of the plurality of downhole valves;

determining the presence of intermittent fluid flow within the wellbore based on the measured fluid parameter;

selectively actuating each of the plurality of downhole valves based on the measured fluid parameter; and controlling the intermittent fluid flow within the wellbore based on the selective actuation step, wherein the fluid parameter is a fluid flow rate through the valve.

43. A downhole valve system, the system comprising:

a plurality of downhole valves coupled to a downhole tubular within a wellbore, wherein each of the plurality of downhole valves comprises an electric motor, a motor controller, and a flow control member moveable between a plurality of continuously variable valve positions between a fully open position and a fully closed position;

wherein each of the plurality of downhole valves is configured to measure a pressure differential at a location proximate to each of the plurality of downhole valves based on a first pressure sensor coupled to an inside portion of the tubular and a second pressure sensor coupled to an outside portion of the tubular, wherein each of the plurality of downhole valves is configured to be selectively actuated between the plurality of continuously variable valve positions based on the measured pressure differential in response to signals provided by the motor controller.

44. The system of claim 43, wherein each of the plurality of downhole valves is configured to be selectively actuated between a plurality of partially opened positions.

45. The system of claim 43, wherein the plurality of downhole valves comprises a first valve located at a first vertical position in the wellbore, a second valve located at a second vertical position in the wellbore lower than the first valve, a third valve located at a third vertical position in the wellbore lower than the second valve, and a bottom valve.

46. The system of claim 43, further comprising a control system coupled to each of the plurality of downhole valves.

47. The system of claim 46, wherein the control system is at a remote location from the plurality of downhole valves.

48. The system of claim 46, wherein the control system is coupled to the plurality of downhole valves by an electrical cable.

49. The system of claim 46, wherein the control system is configured to selectively actuate each of the plurality of downhole valves to move between an open position and a closed position.

50. The system of claim 43, wherein each of the plurality of downhole valves comprises a processor coupled to a motor that is configured to actuate the valve from a closed position to an open position.

51. The system of claim 43, wherein the selective actuation is based on a measured fluid parameter at each of the plurality of downhole valves.

52. A method of operating a plurality of downhole valves in a wellbore, comprising:

measuring a pressure differential at each of a plurality of downhole valves coupled to a tubing string in a wellbore, wherein each of the plurality of downhole valves comprises an electric motor, a motor controller, and a flow control member moveable between a plurality of continuously variable valve positions between a fully open position and a fully closed position;

selectively actuating each of the plurality of downhole valves based on the measured pressure differential;

positioning the flow control member in response to electronic signals from the motor controller based on the actuating step; and maintaining a desired pressure differential at each of the plurality of downhole valves based on the positioning step.

53. The method of claim 52, wherein the actuating step comprises selectively actuating each of the plurality of downhole valves to obtain a desired pressure differential at each of the plurality of downhole valves.

54. The method of claim 52, further comprising maintaining at least some of the plurality of downhole valves in an open position for a predetermined period of time based on the measured pressure differential.

55. The method of claim 52, further comprising determining the presence of intermittent fluid flow within the wellbore based on an increased pressure differential of the measured pressure differential; and controlling the intermittent fluid flow within the wellbore based on the selective actuation step.

* * * * *